US007612031B2

(12) United States Patent
Lang et al.

(10) Patent No.: US 7,612,031 B2
(45) Date of Patent: Nov. 3, 2009

(54) HEALTH-AND-HYGIENE APPLIANCE COMPRISING A DISPERSIBLE COMPONENT AND A RELEASABLE COMPONENT DISPOSED ADJACENT OR PROXIMATE TO SAID DISPERSIBLE COMPONENT; AND PROCESSES FOR MAKING SAID APPLIANCE

(75) Inventors: Frederick J. Lang, Neenah, WI (US); Brendon F. Ribble, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 537 days.

(21) Appl. No.: 11/305,183

(22) Filed: Dec. 15, 2005

(65) Prior Publication Data

US 2007/0142256 A1 Jun. 21, 2007

(51) Int. Cl.
*C11D 17/00* (2006.01)

(52) U.S. Cl. ..... 510/451; 510/439; 510/455; 510/445; 510/143; 510/146; 510/152; 510/139; 510/138; 510/130; 510/133; 424/443

(58) Field of Classification Search ..... 510/451, 510/143, 146, 152, 139, 138, 130, 133, 439, 510/141; 424/443
See application file for complete search history.

(56) References Cited

U.S. PATENT DOCUMENTS 2,403,925 A 7/1946 Ittner
2,494,891 A 1/1950 Marshall
2,524,999 A 10/1950 Schulerud
2,525,081 A 10/1950 Schulerud (Continued)

FOREIGN PATENT DOCUMENTS

DE 198 26 430 C2 7/2000

(Continued)

OTHER PUBLICATIONS

"Surfactant Encyclopedia," *Cosmetics & Toiletries*, vol. 104, No. 2, Feb. 1989, pp. 67-111.

(Continued)

*Primary Examiner*—Mark Eashoo
*Assistant Examiner*—Jane L Stanley
(74) *Attorney, Agent, or Firm*—R. Joseph Foster, III; Sebastian C. Pugliese, III

(57) ABSTRACT

The present invention is directed to a health-and-hygiene appliance comprising a dispersible component and a releasable component. Some or all of the releasable component is not homogeneously distributed throughout the dispersible component. Instead, the releasable component is disposed adjacent or proximate to the dispersible component, as would occur if the dispersible component was coated, sprayed, injected, deposited, printed, or otherwise associated with a formed dispersible component. One example of such an appliance is a cleansing product in which, on exposure to liquid, such as water, the dispersible component disperses or disintegrates, thereby releasing, and making available, all or substantially all of the releasable component, in this case a soap, cleanser, or other formulation. The releasable component may be released prior to, concurrent with, and/or after dispersal or disintegration of the dispersing component. The appliance can be sized for convenient handling by a caregiver or user—e.g., a child—and for delivery of a pre-selected amount of the releasable component in a single use.

17 Claims, 3 Drawing Sheets

U.S. PATENT DOCUMENTS

| | | | | |
|---|---|---|---|---|
| 2,640,033 | A | 5/1953 | Marshall | |
| 3,658,985 | A | 4/1972 | Olson, Jr. et al. | |
| 3,708,425 | A | 1/1973 | Compa et al. | |
| 3,769,398 | A | 10/1973 | Hewitt | |
| 3,830,941 | A | 8/1974 | Luft et al. | |
| 3,835,058 | A | 9/1974 | White | |
| 3,935,129 | A | 1/1976 | Jabalee | |
| 4,013,787 | A | 3/1977 | Varlerberghe et al. | |
| 4,129,515 | A | 12/1978 | Foster | |
| 4,154,706 | A | 5/1979 | Kenkare et al. | |
| 4,203,857 | A * | 5/1980 | Dugan | 15/104.93 |
| 4,224,195 | A | 9/1980 | Kawasaki et al. | |
| 4,259,204 | A | 3/1981 | Homma | |
| 4,329,334 | A | 5/1982 | Su et al. | |
| 4,329,335 | A | 5/1982 | Su et al. | |
| 4,329,336 | A | 5/1982 | Su et al. | |
| 4,379,171 | A | 4/1983 | Furda et al. | |
| 4,450,091 | A | 5/1984 | Schmolka | |
| 4,517,204 | A | 5/1985 | Mottur et al. | |
| 4,576,108 | A | 3/1986 | Socola et al. | |
| 4,595,526 | A | 6/1986 | Lai | |
| 4,913,919 | A | 4/1990 | Cornwell et al. | |
| 5,089,535 | A * | 2/1992 | Malwitz et al. | 521/141 |
| 5,133,909 | A | 7/1992 | Suominen | |
| 5,219,487 | A | 6/1993 | Heile, Jr. et al. | |
| 5,260,078 | A | 11/1993 | Spicer | |
| 5,264,145 | A | 11/1993 | French et al. | |
| 5,364,575 | A | 11/1994 | Doom, Sr. et al. | |
| 5,514,399 | A | 5/1996 | Cordera et al. | |
| 5,569,692 | A | 10/1996 | Bastioli et al. | |
| 5,602,088 | A | 2/1997 | Tokosh et al. | |
| 5,698,252 | A | 12/1997 | Kelly et al. | |
| 5,700,344 | A | 12/1997 | Edgington et al. | |
| 5,753,724 | A | 5/1998 | Edgington et al. | |
| 5,895,780 | A | 4/1999 | Tokosh et al. | |
| 6,187,728 | B1 * | 2/2001 | McManus | 510/142 |
| 6,365,680 | B1 | 4/2002 | Edgington et al. | |
| 6,530,623 | B1 * | 3/2003 | Kazumura | 300/21 |
| 6,537,663 | B1 * | 3/2003 | Chang et al. | 428/394 |
| 6,607,772 | B1 | 8/2003 | Bortone | |
| 6,612,846 | B1 | 9/2003 | Underhill et al. | |
| 6,706,775 | B2 * | 3/2004 | Hermann et al. | 521/134 |
| 6,722,873 | B2 | 4/2004 | Bortone | |
| 6,797,213 | B2 | 9/2004 | Bortone et al. | |
| 6,896,521 | B2 | 5/2005 | Underhill et al. | |
| 7,053,029 | B2 | 5/2006 | MacDonald et al. | |
| 7,417,019 | B2 * | 8/2008 | Weber et al. | 510/446 |
| 2002/0034475 | A1 | 3/2002 | Ribi | |
| 2003/0106812 | A1 * | 6/2003 | Wilkman | 206/210 |
| 2003/0186826 | A1 * | 10/2003 | Eccard et al. | 510/130 |
| 2003/0203010 | A1 * | 10/2003 | Wallo | 424/443 |
| 2004/0029764 | A1 * | 2/2004 | Weber et al. | 510/446 |
| 2004/0048759 | A1 | 3/2004 | Ribble et al. | |
| 2004/0053808 | A1 | 3/2004 | Raehse et al. | |
| 2004/0253297 | A1 * | 12/2004 | Hedges et al. | 424/443 |
| 2005/0026793 | A1 * | 2/2005 | Caswell et al. | 510/101 |
| 2005/0034581 | A1 | 2/2005 | Bortone et al. | |
| 2005/0049157 | A1 | 3/2005 | MacDonald et al. | |
| 2005/0118237 | A1 | 6/2005 | Krzysik et al. | |
| 2005/0239029 | A1 | 10/2005 | Yzermans et al. | |
| 2005/0256758 | A1 | 11/2005 | Sierra et al. | |
| 2006/0287215 | A1 | 12/2006 | McDonald et al. | |
| 2007/0026028 | A1 | 2/2007 | Close et al. | |
| 2007/0098768 | A1 | 5/2007 | Close et al. | |
| 2008/0312123 | A1 * | 12/2008 | Weber et al. | 510/451 |

FOREIGN PATENT DOCUMENTS

| | | | |
|---|---|---|---|
| EP | 0 365 160 | A2 | 4/1990 |
| EP | 0 548 204 | B1 | 6/1995 |
| EP | 0 713 526 | B1 | 7/1997 |
| EP | 1 046 747 | A1 | 10/2000 |
| EP | 1 120 459 | A1 | 8/2001 |
| EP | 1 239 027 | A1 | 9/2002 |
| GB | 2 389 117 | A | 12/2003 |
| GB | 2 418 357 | A | 3/2006 |
| WO | WO 99/24020 | A1 | 5/1999 |
| WO | WO 01/25390 | A2 * | 4/2001 |
| WO | WO 02/26928 | A1 | 4/2002 |
| WO | WO 02/051974 | A2 | 7/2002 |
| WO | WO 2004/087856 | A1 | 10/2004 |
| WO | WO 2004/087857 | A1 | 10/2004 |

OTHER PUBLICATIONS

Barnett, Gabriel, "Emollient Creams and Lotions," Chapter 2, *Cosmetics—Science and Technology*, Second Edition, vol. 1, John Wiley & Sons, Inc., 1972, pp. 27-104.

"Cheetos Mystery Colorz Snacks Taste Cheesy Like Cheetos; Looks Neon Orange Like Cheetos; Magically Turns Color in Mouth," Frito-Lay Press Release, Internet web page "http://www.pepsico.com/news/fritolay/2002/20020107f.shtml", Jan. 7, 2002, 1 page.

"Eco-Foam® Starch Based Packing Material," National Starch and Chemical Company, E-Wire press release, Internet web page "http://www.gsenet.org/library/03bus/foampack.php" Apr. 2, 1998, 1 page.

Flick, Ernest W., "Soaps," Section XII, *Cosmetic and Toiletry Formulations*, Second Edition, Noyes Publications, Park Ridge, New Jersey, 1989, pp. 707-744.

"Friendly Packaging," list of biodegradable packaging materials including Eco-Foam, Internet web page "http://www.friendlypackaging.org.uk/materialslist.htm", Dec. 3, 2001, pp. 1-5.

Lochhead, R.Y., "Natural and Modified Natural Polymers and Thickeners and Their Derivatives," pp. 100-113, and "Synthetic Polymers and Thickeners," pp. 113-129, *Cosmetics & Toiletries*, vol. 103, No. 12, Dec. 1988.

"Moma Knows Best About Loose Fill," Internet web page "http://www.packworld.com/cds_print.html?rec_id=942", Eco-Foam, National Starch and Chemical Company, first published Jun. 1995, 3 pages.

Strianse, S.J., "Hand Creams and Lotions," Chapter 5, *Cosmetics—Science and Technology*, Second Edition, vol. 1, John Wiley & Sons, Inc., 1972, pp. 179-222.

"Sun Products Formulary," *Cosmetics & Toiletries*, vol. 102, No. 3, Mar. 1987, pp. 117-122, 125-131.

"Sunscreen Use in Cosmetic Formulas," *Cosmetics & Toiletries*, vol. 102, No. 3, Mar. 1987, pp. 67-68.

DiSapio, Alfred J., "Silicones as Adjuvants in Sun Products," *Cosmetics & Toiletries*, vol. 102, No. 3, Mar. 1987, pp. 102-106.

Fox, Charles, "Sunscreen and Suntan Products: Patent and Literature Update," *Cosmetics & Toiletries*, vol. 102, No. 3, Mar. 1987, pp. 41-44, 46-48, 50, 54, 58-65.,m.

Shaath, Nadim A., Encyclopedia of UV Absorbers for Sunscreen Products, *Cosmetics & Toiletries*, vol. 102, No. 3, Mar. 1987, pp. 21-36, 39.

* cited by examiner

HEALTH-AND-HYGIENE APPLIANCE COMPRISING A DISPERSIBLE COMPONENT AND A RELEASABLE COMPONENT DISPOSED ADJACENT OR PROXIMATE TO SAID DISPERSIBLE COMPONENT; AND PROCESSES FOR MAKING SAID APPLIANCE

BACKGROUND OF THE INVENTION

Health-and-hygiene appliances and compositions are used everyday, by people everywhere, to promote health and well being.

One such example of a health-and-hygiene composition—in this case a cleaning composition—is used to promote good hygiene. One of the most effective methods found to date for limiting the spread of communicable disease is through effective personal cleaning, particularly through thorough hand washing. Thorough hand cleaning includes not only washing often with a suitable cleanser, but also washing for a period of time long enough to ensure sanitary conditions have been attained. For example, the Centers for Disease Control and Prevention recommend that persons wash with soap for 10 to 15 seconds after first wetting their hands.

Many soaps and other detergent cleansers can provide the desired levels of hygiene if used correctly. These cleansers, however, are usually supplied to the public in bar or liquid form, and people, particularly children, often wash their hands in a cursory fashion, and therefore may not effectively remove dirt, grime, and/or disease-causing agents.

In one attempt to address such problems, liquid cleansers have been developed which change color after a certain amount of time spent scrubbing. Such cleansers may be expensive, however, and some are directed toward medical applications, such as surgical scrubbing applications. Thus, a need exists for a health-and-hygiene appliance that is moderately priced and can be adapted to encourage desired scrubbing times, even when used by children.

Another problem experienced with cleansers today involves difficulties in handling the cleanser as well as the unsightliness around the sink area caused by the cleansers themselves. For example, when using a bar soap, not only can the bar itself become unsightly as it is used slowly over time, but soap residue can build up on the soap dish or tray and the sink itself, causing an unsightly mess. Bar soaps are often slippery and difficult to hold onto when wet. Liquid cleansers also can cause problems. For example, inadvertent release of excess cleanser from the dispenser can lead not only to soap building up in and around the sink, but also on the bottle itself, causing the bottle to become slick and difficult to hold as well as messy. Furthermore, such release of excess cleanser may be wasteful, in that more cleanser is dispensed and used than is necessary for effective cleaning. Liquid cleanser dispensers may also become clogged, due to build up of liquid at the dispenser outlet. On continued exposure to air, such build up at the dispenser outlet may harden, further contributing to dispensing problems.

As such, a further need exists for a health-and-hygiene appliance—in this instance an appliance comprising a cleansing formulation—that can be delivered to the consumer in a form which can provide the desired cleaning action without causing untidiness in or around the sink. A need also exists for an appliance that can deliver a pre-selected amount of a cleaner in a precise dose.

Expanded foam is a material which has been used to produce a large variety of articles. For example, expanded polystyrene foam has been used to form packing material and light-weight disposable articles such as plates, cups, serving trays, etc. Recently, foams have been developed which are more environmentally friendly, i.e. biodegradable, than the petroleum-based foams of the past. In certain instances, these biodegradable foams can include a destructured starch.

Destructured starch is starch which has had the crystalline structure destroyed and has become thermoplastic in nature. A starch can be destructured by various methods involving combinations of pressure, heat, and mechanical work in the presence of plasticizers and/or destructuring agents such as urea and alkaline hydroxides. For example, starch can be heat treated above the glass transition temperature and melting points of its components, generally above about 120° C., in the presence of destructuring agents to become destructured starch. For additional information concerning destructured starch, see, for example, U.S. Pat. No. 5,569,692 to Bastioli, et al. which is incorporated herein by reference as to all relevant matter.

Other such dispersible components that are dispersible in water or other liquids are known.

The present invention provides for a health-and-hygiene appliance comprising a dispersible component and a releasable component. Some or all of the releasable component is adjacent or proximate to the dispersible component. I.e., not all of the releasable component is homogeneously distributed throughout the dispersible component. When making such a health-and-hygiene appliance, some or all of the releasable component will be coated, sprayed, injected (e.g., within any internal cavity or hollowed-out portion defined by the dispersible component), or otherwise applied to the already-formed dispersible component (i.e., generally the dispersible component is substantially intact when the releasable component is applied). Upon said dispersible component dispersing or disintegrating in water or other liquid, the releasable component is released (note: at least some portion of the releasable component may release before, concurrent to, or after the dispersible component disintegrates or disperses in a liquid, such as water). The source of the water or liquid could be external to the health-and-hygiene appliance comprising the dispersible component and releasable component, e.g. from a spigot; or the water or liquid could be released from microcapsules incorporated into the dispersible component, the releasable component, or both. In one representative version of the invention, the releasable component is a soap or other cleansing formulation deposited on, coated on, sprayed on, or otherwise releasably associated with, a dispersible component (such as an expanded, water-soluble foam material). The volume or size of the dispersible component, and the amount of the releasable component associated with the dispersible component, may be selected so that a pre-selected amount of soap or cleaning formulation is released and substantially available for cleaning in a single use. That is, in a single use, and on contact with water or other liquid, substantially all of the dispersible component is dispersed or disintegrated, and substantially all of the releasable component is released and available to a user of the appliance. For example, for children, the dispersible component might be fashioned into a sphere or other shape (e.g., an animal, kite, animated character, or other shape attractive to children) that is easily handled by children. The amount of the releasable component, in this case a cleanser, can be selected to correspond to the amount of cleanser effective for its intended purpose. Furthermore, this same version of the invention may include characteristics that help the child know when he or she has washed his or her hands for a specific duration (e.g., the 10-15 seconds identified above). E.g., the releasable component, dispersible component, or both may be formulated to contain a color-changing ingredient adapted to change color after 10-15 seconds or so, thus providing a signal to the child that hand washing is effective and complete. Such color-changing dyes, such as thermochromic dyes, are known and can be purchased from various vendors (see Description below; see also co-pending U.S. patent application Ser. No. 11/155,353, entitled "Color-Changing Composition Comprising a Thermochromic Ingredient," filed on 17 Jun. 2005, which is hereby incorporated by reference in its entirety in a manner consistent herewith). Or, alternatively, the health-and-hygiene appliance can be adapted to completely disintegrate after this duration, again providing a signal to the child that hand washing is effective and complete. Other sizes and shapes of the appliance may be selected for adults (e.g., a smaller sphere with an effective amount of soap coated on said sphere). Other representative versions of the invention are described in the following sections.

SUMMARY OF THE INVENTION

In one embodiment, the present invention is directed to a novel health-and-hygiene appliance comprising a releasable component adjacent or proximate to a dispersible component, with the appliance serving as a personal-cleansing product. For example, the releasable component can be a soap or other formulation deposited on, and releasably associated with, a dispersible component. The dispersible component can be an extruded foam that disintegrates or disperses when the appliance is used with water or other liquid. Some or all of the releasable component, here a soap or other formulation, is not homogeneously distributed throughout the dispersible component. Instead some or all of the releasable component is coated, sprayed, deposited, printed, injected, or otherwise associated with the formed dispersible component. As the health-and-hygiene appliance disintegrates and/or disperses, it releases the cleanser, soap, or other formulation. In one embodiment, before the health-and-hygiene appliance, in this case a personal cleansing product, disintegrates completely, it can provide a timed or time-controlled duration of scrubbing which can ensure desired levels of cleanliness after use.

In general, the dispersible component can be any material that, on contact with liquid or water, disperses or disintegrates over time so that a releasable component, such as a soap or other formulation, is released and available to the user of the health-and-hygiene appliance. As mentioned above, at least some portion of the releasable component, if not all of it, is not homogeneously distributed throughout the dispersible component. In some cases the releasable component is in some way contained within a macroscopic article made up of the dispersible component (e.g., the dispersible component could be a hollow shape, such as a hollow pellet or tube, with the releasable component injected, inserted, or otherwise placed into the interior of such hollow shape). In one representative version, the dispersible component is formed from a mixture which includes a natural starch, a water-soluble disintegrant, a water-soluble polymer, a nucleating agent, and a blowing agent. The mixture can be extruded to form the expanded foam, to which is added a soap, cleanser, or other formulation that is adapted to be released from said foam when it disintegrates or disperses upon use of the health-and-hygiene appliance. As the foam disintegrates during the washing process, the soap, cleanser, or other formulation is released from the foam.

The liquid-soluble disintegrant in the dispersible component can be a dextrin, such as maltodextrin. In one embodiment, from about 20% to about 65% by weight of the ingredients fed to the extruder can be a liquid-soluble disintegrant.

In one embodiment, the blowing agent in the dispersible component can be an alcohol, such as ethanol. Generally, from about 5% to about 10% by weight of the ingredients in the extruder can be a blowing agent.

The releasable components, such as a soap base, can be any desired soap base known in the art. For example, a fatty-acid soap or other types of surfactant detergents, such as synthetic detergents, can be used as the soap which is released as the dispersible component disintegrates. Again, as discussed elsewhere, the releasable component can release, in whole or in part, before, during, and/or after dispersal or disintegration of the dispersing component. As is discussed below, the releasable component may be added to the dispersible component in many ways, including tumbling the dispersible component (e.g., an extruded foam or other material) with the releasable component (e.g., a soap in powder form) plus any optional ingredients, including, for example, one or more materials that help attach the releasable component to the dispersible component; spraying of the releasable component onto the dispersible component; dipping the dispersible component into the releasable component; wrapping the releasable component around the dispersible component; gluing the releasable component to the dispersible component; molding the releasable component to the dispersible component; melting the releasable component onto the dispersible component; coating the releasable component, e.g., in the form of a water-dispersible film, on the dispersible component; etc.

A water-soluble polymer may be included in the dispersible component. In one embodiment, the water-soluble polymer can be a water-soluble thermoplastic polymer such as, for example, polyvinyl alcohol. In general, the dispersible component can include between about 5% and about 10% water-soluble polymer.

The dispersing component can also include between about 5% and 10% by weight nucleating agent. In one embodiment, the nucleating agent can be talc, for example a food grade talc.

The dispersing component also can include a natural starch. In one embodiment the dispersing component comprises between about 3% and about 10% natural starch.

Optionally, other additives can be included in the dispersible component including, for example, a destructured starch, if desired (suitably up to about 25% by weight).

Other possible additives to the dispersing component can include additives generally known in the art such as, for example, dyes, fragrances, emollients, antioxidants, vitamins, etc. Moreover, desired additives can be added either directly to the ingredients used to make the dispersing component or optionally can be encapsulated, such that they are released later, for example, when the health-and-hygiene appliance is used in the presence of a liquid, such as water, and/or under pressure due to scrubbing action. As noted above, microcapsules may also be used to encapsulate the water or other liquid that will serve to facilitate dispersal or disintegration of the dispersing component. Note also that one or more of these same additives may, in whole or in part, be added to the releasable component, rather than the dispersing component. In fact, one of the advantages of this invention is that the method of preparing the health-and-hygiene appliance comprising a dispersible component and a releasable component decouples, in whole or in part, preparation of the dispersible component from preparation and addition of the releasable component. While, at first blush, such decoupling may appear costly, and may complicate the manner by which the health-and-hygiene appliance is prepared, we have found that such decoupling provides increased flexibility in designing and preparing appliances of the present invention. For example, if the dispersible component is to be prepared using an extruder, then the ingredients for preparing the dispersible component are subjected to the temperatures and pressures of an extruder. Some of the ingredients that may be used in a health-and-hygiene appliance may degrade or be altered by such temperatures or pressures. Accordingly, preparing a health-and-hygiene appliance in a single step, using, for example, an extruder, will limit the combinations of ingredients that can be used to prepare said appliance. By separating, at least in part, preparation of a dispersible component from preparation and addition of a releasable component to the dispersible component, many inventive health-and-hygiene appliances may be made. Thus appliances where some or all of the releasable component is not homogeneously distributed throughout the appliance—as would be obtained when preparing, in one step, an appliance using an extruder—provides important advantages. It should be noted, from the discussion above, that the present invention encompasses health-and-hygiene appliances where some portion of a releasable material, e.g. a surfactant-based soap, may be present in the dispersible component, so long as the appliance also comprises a releasable component that is adjacent or proximate to said dispersible component, and not homogeneously distributed through said dispersible component.

In some versions of the invention, ingredients are employed in the releasable component, the dispersible component, or both such that a signal is conveyed to a user of the appliance. The signal can be in any form, including visual, tactile, auditory, or olfactory. As mentioned above, for example, color-changing ingredients can be employed that cause the appliance, or some portion thereof, to change color during use of the appliance. Various aromatic ingredients can be employed that release a scent. Ingredients may be employed that, when the appliance disperses or degrades, result in the release of particles or other materials detectable by touch. Alternatively, ingredients may be employed that make a sound during use of the appliance. As stated elsewhere, one or more of these kinds of ingredients may be encapsulated such that the ingredient is available only after some external stimulus (e.g., contact with water, pressure; etc.) ruptures or dissolves the capsule, thereby releasing the capsule's ingredients and/or contents.

In one embodiment, the health-and-hygiene appliance can be an abrasive cleansing product and abrasion-enhancing additives can be included in the releasable component, dispersible component, or both.

As the appliance is used to clean, the dispersible component can disintegrate and release the releasable component, such as a soap base. In one embodiment, the time for disintegration can be less than about 2 minutes. The disintegration can be triggered by contact time with water (or other liquid), water temperature (or liquid temperature), scrubbing pressure, or any combination of the three. As noted elsewhere, a time for disintegration can be selected to correspond to 10 or 15 seconds, or some other time corresponding to the effectiveness of the composition being released and made available for use by a user of the health-and-hygiene appliance.

In another possible embodiment, the present invention is directed to a process for producing a health-and-hygiene appliance comprising a dispersible component and a releasable component releasably attached to said dispersible component, wherein the releasable component, or some portion thereof, is not homogeneously distributed throughout the dispersible component. In general, the process includes providing a dispersible component (e.g., an extruded foam that disintegrates in liquid, such as water); providing a releasable component (e.g., a soap or other formulation); and depositing, coating, spraying, injecting, printing, or otherwise associating the releasable component with the dispersible component, including any optional ingredients, such as, for example, binders that help releasably attach the releasable component to the dispersible component.

In one representative version of the process, the dispersible component is prepared by combining a variety of ingredients to form a mixture and then expanding the mixture by passage through an extruder to form a foam. For example, in one embodiment, between 0% and about 25% by weight destructured starch, between about 20% and about 65% by weight water-soluble disintegrant, between about 5% to about 10% by weight water-soluble thermoplastic polymer, between about 5% and about 10% by weight nucleating agent, between about 3% and about 10% natural starch, and between about 5% and about 10% by weight alcohol can be mixed and then expanded to form an extruded dispersible component.

The ingredients can be mixed in a mixer, such as a Hobart® mixer, for example, and then transferred to the extruder, or alternatively can be added directly to the extruder and mixed within the extruder, as desired. Any suitable extruder can be used, for example, either a single-screw or a twin-screw extruder can be used. Suitably, a conical twin-screw extruder can be used in the process. In one embodiment, a co-extrusion process can be used, and the dispersible component can include zones of different materials.

If used to prepare the dispersible component, the extruder can operate at a screw speed of between about 50 and about 250 rpm. Additionally, the feed zone of the extruder can be between about 80° C. and about 130° C. and the nozzle temperature of the extruder can be between about 100° C. and about 175° C.

The health-and-hygiene appliances of the present invention can be of any desired shapes and orientations. In some embodiments, the size and volume of the shape are selected for attractiveness and/or ease of use by the user of the appliance (e.g., larger, decorative shapes may be formed that are easily handled by children, and which release a pre-selected amount of the releasable component—in this case a soap formulation—for effective cleaning). In one embodiment, several individual foamed product pieces can be attached together to form a conglomerate of individual products which together form a large structure.

The health-and-hygiene appliances of the present invention may be placed in liquid-impermeable packages, either individually, as a collection of two or more, or some combination thereof, to limit degradation of the dispersible component prior to use of the appliance. Furthermore, the appliances themselves may be placed in individual envelopes or wrapping—with the envelopes or wrapping optionally comprising a liquid-impermeable material. Also, the appliances may be prepared in a form resembling a Hershey's®-brand chocolate bar, in which a consumer can break the bar into individual sizes preferred by the consumer (e.g., the overall bar may be rectangular, but is segmented into 16 smaller rectangles that are adapted to be broken from the larger bar in any number preferred by the consumer, such as 1 smaller rectangle, 2 smaller rectangles remaining connected to each other, etc.). For the present invention, the health-and-hygiene appliance may be formed as a shape that is itself segmented into smaller elements that are adapted to be broken from the shape in any fashion desired by the consumer.

Furthermore, statements associating use of the appliance with good hygiene, health, or well being may be placed on or in said package. Or, alternatively, such statements may be embodied in a tangible medium adapted to be conveyed to potential users of said appliances.

Also, the size and volume of the appliance, as well as the amount of releasable component deposited or otherwise associated with the dispersible component of said appliance, may be selected to convey a signal to the user of the appliance. For example, as noted above, the materials of construction and size of the dispersible component may be selected such that the component disperses or disintegrates after a certain time duration. Alternatively, the dispersible component, the releasable component, or both may include materials that create a change perceivable by the user of the appliance. For example, the appliance can include color-changing ingredients, such as thermochromic materials, that will change color only after exposure to warm water. Other versions of the invention, as well as additional description, is provided in the sections that follow.

BRIEF DESCRIPTION OF THE FIGURES

A full and enabling disclosure of the present invention, including the best mode thereof to one of ordinary skill in the art, is set forth more particularly in the remainder of the specification, including reference to the accompanying figures in which.

Figure 1:
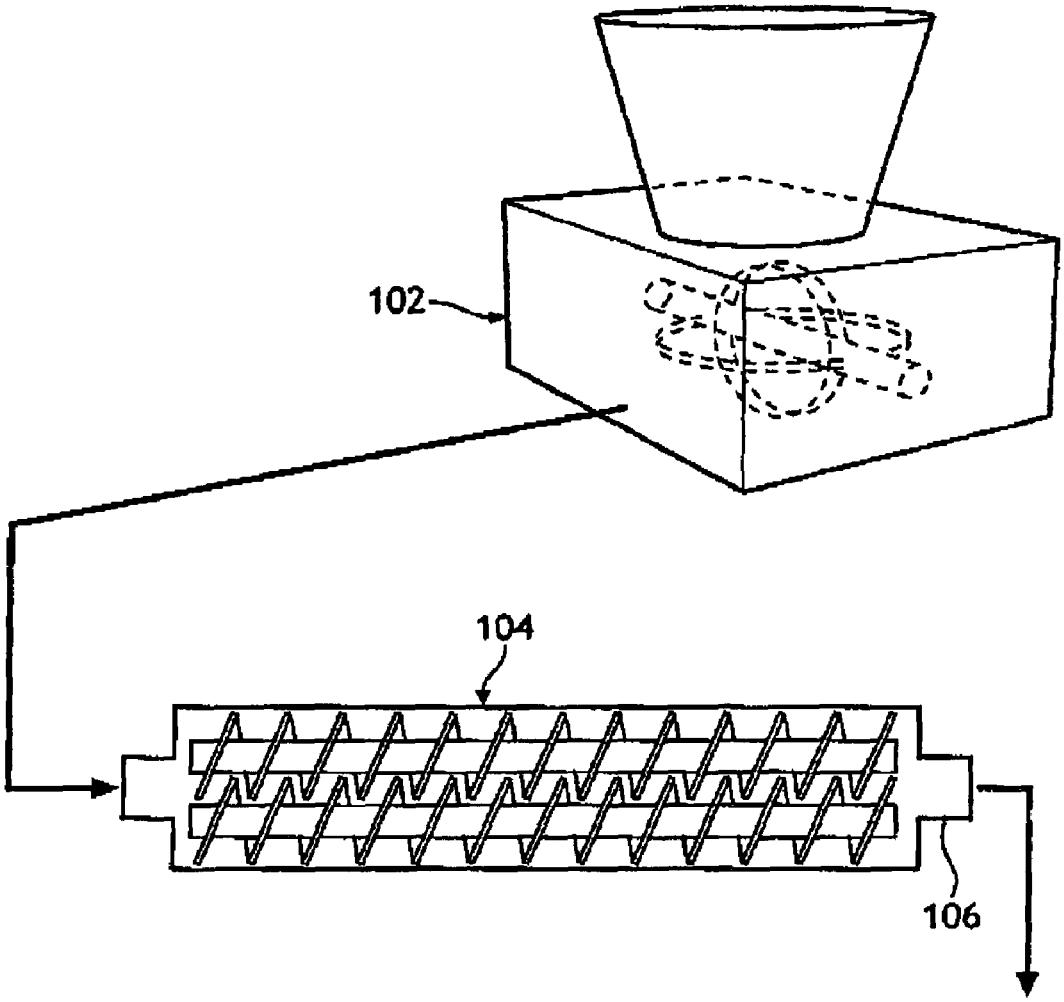
FIG. 1 is one embodiment of a process for producing one version of a dispersible component of a health-and-hygiene appliance of the present invention.

Repeat use of reference characters in the present specification and drawings is intended to represent same or analogous features or elements of the present invention.

DEFINITIONS

Within the context of this specification, each term or phrase below includes the following meaning or meanings:

"Attach" and its derivatives refer to the joining, adhering, connecting, bonding, depositing on, associating with, or the like, of two elements. Two elements will be considered to be attached together when they are attached directly to one another or indirectly to one another, such as when each is directly attached to intermediate elements. "Attach" and its derivatives include releasable attachment.

"Bond" and its derivatives refer to the joining, adhering, connecting, attaching, or the like, of two elements. Two elements will be considered to be bonded together when they are bonded directly to one another or indirectly to one another, such as when each is directly bonded to intermediate elements. "Bond" and its derivatives include releasable bonding.

"Cleaning composition", "cleaning formulation," or their derivatives refer to personal care or cleaning formulations or compositions, shampoos, lotions, body washes, hand sanitizers, bar soaps, etc., whether in the form of a solid, liquid, gel, paste, foam, or the like. "Cleaning compositions" also encompass moisturizing formulations. It should be noted that when liquid or water-based ingredients are employed in a releasable composition, these ingredients must be employed so that the liquid or water does not prematurely disperse or disintegrate the dispersible component. So, for example, if such ingredients are used, they may be encapsulated so that the water or liquid does not interact with the dispersible component prior to use of the corresponding health-and-hygiene appliance. Alternatively, the ingredients of the releasable component may be employed in a substantially dry and/or non-liquid/non-aqueous state.

"Connect" and its derivatives refer to the joining, adhering, bonding, attaching, or the like, of two elements. Two elements will be considered to be connected together when they are connected directly to one another or indirectly to one another, such as when each is directly connected to intermediate elements. "Connect" and its derivatives include releasable connection.

"Disposable" refers to articles which are designed to be discarded after a limited use rather than being laundered or otherwise restored for reuse.

The terms "disposed on," "disposed along," "disposed with," or "disposed toward" are intended to mean that one element can be integral with another element, or that one element can be a separate structure bonded to or placed with or placed near another element.

The terms "disposed adjacent to" or "disposed proximate to" mean that one element is a separate structure that is bonded to, attached to, placed with, or placed near another element.

"Layer" when used in the singular can have the dual meaning of a single element or a plurality of elements.

"Liquid impermeable," when used in describing a layer or multi-layer laminate means that liquid will not pass through the layer or laminate, under ordinary use conditions, in a direction generally perpendicular to the plane of the layer or laminate at the point of liquid contact.

"Liquid permeable" refers to any material that is not liquid impermeable.

"Member" when used in the singular can have the dual meaning of a single element or a plurality of elements.

Words of degree, such as "about", "substantially", and the like are used herein in the sense of "at, or nearly at, when given the manufacturing and material tolerances inherent in the stated circumstances" are used to prevent the unscrupulous infringer from unfairly taking advantage of the invention disclosure where exact or absolute figures are stated as an aid to understanding the invention.

"Particle," "particles," "particulate," "particulates" and the like, refer to a material that is generally in the form of discrete units. The particles can include granules, pulverulents, powders or spheres. Thus, the particles can have any desired shape such as, for example, cubic, rod-like, polyhedral, spherical or semi-spherical, rounded or semi-rounded, angular, irregular, etc. Shapes having a large greatest dimension/smallest dimension ratio, like needles, flakes and fibers, are also contemplated for use herein. The use of "particle" or "particulate" may also describe an agglomeration including more than one particle, particulate or the like.

DETAILED DESCRIPTION

Reference now will be made in detail to embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

In general, the present invention is directed to a novel health-and-hygiene appliance comprising a dispersible component and a releasable component adapted to release from said dispersible component when the dispersible component disperses or disintegrates in, for example, a liquid such as water. Some or all of the releasable component is not homogeneously distributed throughout the dispersible component. Instead, the releasable component—at least some portion thereof—is deposited, coated, sprayed, printed, injected or otherwise associated with the dispersible component after the dispersible component has been formed. I.e., some or all of the releasable component is disposed adjacent to said dispersible component. Generally this means that some or all the releasable component will be associated with the surface of the dispersible component. If the dispersible component is porous, the releasable component may be associated with pores extending into the shaped article defined by the dispersible component. Alternatively the releasable component may be inserted, injected, or otherwise placed on the interior of the dispersible component if the dispersible component defines a hollow portion or cavity.

The present invention discloses a process for making the health-and-hygiene product. Generally, the process includes the steps of providing a dispersible component; providing a releasable component; and associating the releasable component with the dispersible component so that the releasable component will be released when the dispersible component disperses or disintegrates in, for example, a liquid such as water. In some representative versions of the invention, the dispersible component is an extruded foam that can disintegrate while in contact with a liquid, such as water, as it is used to scrub the hands, face, body, etc.

In one embodiment, the health-and-hygiene appliance can be sized for a single use. In this embodiment, as the appliance is used to wash, the dispersible component can disintegrate. In this embodiment, the washing process can continue until the appliance has completely disintegrated. The appliance can be specifically designed for a desired period of disintegration, depending upon the desired appliance characteristics. For example, the appliance can be designed to disintegrate relatively slowly, such as over a period of about 2 minutes or longer, in those embodiments wherein a longer, more thorough scrubbing time is desired, such as medical applications. Alternatively, the appliance can be designed to disintegrate in a shorter amount of time (e.g., 10 or 15 seconds), down to an essentially immediate disintegration, in those embodiments where a quick wash is desired. In general, the appliance of the present invention can disintegrate when in contact with a liquid, such as water, and/or scrubbing pressure in less than about 2 minutes.

Representative Version(s) of a Dispersible Component

In one version of the present invention, the dispersible component is an extruded foam. The foam can include various ingredients such as, for example, a disintegrant, a water-soluble polymer, a nucleating agent, and a natural starch, which are mixed and then expanded with a blowing agent via an extrusion process to form a foam matrix. In one embodiment, the mixture can also include a destructured starch.

The relative amounts of the ingredients can vary depending on the desired appliance characteristics. For example, the relative amounts of the optional destructured starch, and the disintegrant, can be balanced to not only aid in control of the rate of disintegration of the foam, but also to influence the quantity and size of any foam particles remaining after disintegration.

Other components can optionally be included in the appliance to further refine the characteristics of the appliance, such as the disintegration characteristics for instance. Other optional additives, in addition to destructured starch, can include, for example, dyes, vitamins, emollients, abrasive enhancing additives, encapsulated additives, and the like, which can impart desired qualities to the appliance. As noted above, these optional additives may be employed in the releasable component. Given that the releasable component is prepared and added separately to the formed dispersible component, these optional additives need not be selected so that they can withstand the temperatures, pressures, or other operating characteristics of the process used to prepare the dispersible component (e.g., by extrusion).

As the dispersible component of the health-and-hygiene appliance disintegrates or disperses, the various ingredients of the dispersible component can either dissolve completely and be washed away with the wash water (if the appliance is used with a liquid such as water), or can be in small enough particles after disintegration to flow with the water and enter the sewage system without causing harm to drains or wastewater treatment facilities. The relative amounts of the different ingredients and the overall formulation of the dispersible component of the appliance can be varied to affect disintegration rate. For example, the appliance can be designed to disintegrate based upon time of contact with water, temperature of the contact water, pressure due to the scrubbing motion, or some combination thereof. The relative amounts of ingredients as well as the optional additives included in the dispersible component can be varied to obtain the desired disintegration characteristics. The ingredient make-up can also affect other characteristics of the dispersible component such as grittiness during use, color, odor, and texture of the dispersible component, for example.

It should be noted that the ingredients used in the releasable component, or any optional binders used to help attach the releasable component to the dispersible component, may also be selected to modify the disintegration or dispersal rate of the dispersing component. For example, if the dispersing component of the appliance disperses in a liquid, such as water, then the thickness, chemical constituents, and physical characteristics of the releasable component can be selected to affect the rate of transport of liquid to the dispersing component. If the releasable component completely envelops and covers the dispersing component, then the liquid (e.g., water) must first diffuse or otherwise move through the releasable component before reaching the dispersing component. If this is the case, then, as just stated, the thickness, chemical nature, density, and other such characteristics of the releasable layer may be manipulated to change the rate at which the appliance ultimately disperses or disintegrates. Alternatively, the releasable component could dissolve in the liquid, such as water, and other physical characteristics, such as the releasable component's solubility, could be selected to promote the desired dispersal/disintegration rate. Note, too, that the dispersing component need not completely disperse or disintegrate before any of the releasable component is available for use by the consumer. Some or all of the releasable component may be available to a user of the appliance before the dispersing component begins to disperse or dissolve. Also, ingredients, or categories of ingredients, that may be used in a releasable component disposed adjacent or proximate to said dispersing component may also be employed in the dispersing component itself. Thus, upon dispersal of the dispersing component, more of an ingredient already employed in, and made available by, the releasable component, may also be made available when the dispersing component disperses. Alternatively, different ingredients may be made available by the dispersing component that are not employed in the releasable component. Or, as is true in some embodiments, the dispersing component may serve only to support or convey cleaning formulations or compositions, with the cleaning formulation or composition being released immediately prior to, concurrent to, or after dispersal of the dispersing layer. As noted above, by providing that at least some or all of the releasable component is prepared and applied to a formed dispersing component, ingredients that cannot withstand, or are impaired by, the operating conditions used to make the dispersing component, may now be used in the separately prepared and applied releasable component.

It should also be noted that the releasable component can be located on the outside of the dispersible component, on the inside of the dispersible component, or some combination thereof (and, as noted above, one or more ingredients used in the releasable component may also be homogeneously distributed throughout the dispersible component, as is disclosed in U.S. Patent Application Publication No. 2004/0048759 A1, which is hereby incorporated by reference in its entirety in a manner consistent herewith).

The dispersible component of the health-and-hygiene appliance may be an expanded foam such as can be produced through an extrusion process. In general, this involves combining various ingredients until well mixed and extruding through a nozzle. The extrudate expands as it exits the nozzle and the foamed material—i.e., one version of a dispersible component—is thus produced. The foamed material can be formed into any desired shape. For example, a relatively flat sheet of extrudate can exit the extruder which can then be further processed. In one embodiment, flat shapes such as stars, fish, cartoon characters or any other shape can be punched from a flat sheet of extrudate. Such shapes can be further defined or enhanced, if desired, such as with an embossing process. Alternatively, a more three-dimensional foam, such as an endless cylindrical rod can be formed at the nozzle. This can then be cut or otherwise shaped into more three-dimensional product shapes such as balls, crayon-shaped cylinders, cloud puffs, popcorn, candy shapes, and the like. Three-dimensional forms can also be created by molding the extrudate, for example by injection molding the extrudate. In some versions of the present invention, shapes are selected such that, after the shapes are produced by cutting, stamping, or otherwise forming the individual shapes, there is substantially no waste. As an example, if a flat slab of dispersing component was produced by, for example, extrusion, the slab could be treated with a releasable component (e.g., by spraying or coating the slab with a cleaning formulation), and then cut into individual squares, with each square being a health-and-hygiene appliance of the present invention. Other shapes and patterns can be readily selected to minimize waste (e.g., the manner in which repeating patterns or fish interlock in an M. C. Escher image). Note too that the individual shapes of the dispersible component may be formed and separated first, and then combined with the releasable component (e.g., by introducing the individual shapes to a tumbler unit operation in which the releasable component is applied to the dispersible component; this version of a process for making a health-and-hygiene appliance of the present invention is discussed below).

The dispersible component will have an exterior surface to which the releasable component may be applied. As stated elsewhere, the dispersible component may also have a cavity or hollowed-out portion on its interior. If desired, the releasable component may be injected, deposited, or otherwise placed or associated with the cavity, hollowed-out portion, or interior surfaces of the dispersible component. Furthermore, different chemistries may be used on both the exterior surface and any internal cavity or interior. Representative versions of these types of health-and-hygiene appliances are discussed further in the Examples section below.

When the dispersible component of a health-and-hygiene appliance of the present invention is an extruded foam like that described above, the foam can include a water-soluble thermoplastic polymer which is added to the extruder mixture. In one embodiment, a water-soluble thermoplastic polymer such as polyvinyl alcohol can be added to the mixture as a solid and extruded with the other components of the extruded foam. For example, the polyvinyl alcohol can be added in solid form with average particle diameter less than about 100 micrometers. In one embodiment, polyvinyl alcohol with an average particle diameter of between about 40 and about 90 micrometers can be added to the mixture. A water-soluble thermoplastic polymer can impart certain desired qualities to the foamed material such as, for example, improved compressibility and plasticity of the dry dispersible component, and faster and more complete disintegration of the dispersible component when the health-and-hygiene appliance is used. In general, a water-soluble polymer can make up between about 5% and about 10% by weight of the extruder mixture. In one embodiment, the water-soluble polymer can make up about 7.7% by weight of the mixture.

In order to disintegrate or disperse as desired in the presence of liquid, such as water, the dispersible component can include a disintegrant. A disintegrant can be any non-polymeric water-soluble component (when the health-and-hygiene appliance is adapted to disperse or disintegrate with water) which can interfere with cross-linking of the polymers forming the foam matrix. In one embodiment, dextrin can be added to the mixture as a disintegrant. Other disintegrants are possible, however, such as, for example, sugars, such as mannitol, sorbitol, sucrose, lactose, fructose, maltose; salts such as sodium chloride, potassium chloride, calcium sulfate; the amino acids alanine, arginine, asparagine, aspartic acid, cysteine, glutamic acid, glutamine, glycine, histidine, isoleucine, leucine, lysine, methionine, phenylalanine, proline, serine, threonine, tryptophan, tryosine, and valine; buffering agents such as citric acid, sodium citrate, potassium citrate, succinic acid, fumaric acid, sodium acetate, sodium phosphate monobasic, tartaric acid, sodium potassium tartrate; surface active agents such as poloxamers, polysorbates, lecithin and the like; and effervescing couples such as citric acid blended with sodium bicarbonate, and similar blends. Malodextrin, having a molecular weight of about 400 to 4000 grams per mole, is one example of a low-molecular weight polymeric material useful as a disintegrant in this invention.

In one embodiment of the present invention maltodextrin having an average particle diameter of less than about 100 micrometers can be used as the disintegrant. More specifically, maltodextrin having an average particle diameter between about 40 micrometers and about 90 micrometers can be used, though larger disintegrants can alternatively be added to the dispersible component.

The amount of the disintegrant in the dispersible component of the health-and-hygiene appliance can be adjusted to obtain desired disintegration characteristics in the final appliance. For example, increasing the amount of disintegrant while not including any destructured starch in the mixture can create a dispersible component which can disintegrate essentially upon contact with water, releasing the releasable component, such as a soap or other formulation, from the appliance very quickly. Conversely, lesser amounts of disintegrant can be used, such as in those embodiments wherein the dispersible component disintegrates more slowly, requiring the user to wash more vigorously or for a longer period of time before this version of a health-and-hygiene appliance is completely disintegrated and all of the soap or other formulation is released from the dispersible component. In one embodiment, between about 20% and 65% by weight of the mixture to be extruded can be a disintegrant. In one embodiment, between about 30% and about 50% by weight of the mixture can be a disintegrant. In one embodiment, the disintegrant can make up about 38.5% by weight of the extruder mixture.

When the dispersible component is an extruded foam like that generally described herein, the ingredients used to make the dispersible component in the extruder can also contain a blowing agent. The blowing agent can either be a gas or a liquid which is superheated in the extruder. The blowing agent functions to expand the dispersible component and help to form the foam as it exits the extruder nozzle. For example, a liquid blowing agent can be superheated by compression of the extruder screw and cause expansion of the foam at the nozzle. Cell size and amount of total expansion can be affected by the amount and characteristics of the blowing agent added to the ingredients used to form the dispersible component. In the past, water has primarily been the liquid blowing agent of choice in foam-forming technology. However, in the present invention, blowing agents other than water may be used to obtain the desired expansion of the foam. For example, blowing agents including various gases such as carbon dioxide can be introduced to the extruder just prior to final extrusion at the nozzle.

Alternatively, a liquid-blowing agent, such as an alcohol, can be added to the ingredients used to make this version of a dispersible component in the extruder. For example, ethanol can be used as a liquid-blowing agent added to the extruder mixture. In one embodiment, from about 5% to about 10% by weight of the mixture in the extruder can be a liquid-blowing agent, such as, for example, ethanol. In one embodiment, the mixture can include about 7.7% blowing agent.

The dispersible component of a health-and-hygiene appliance of the present invention can also include a natural starch in the ingredients used to make said dispersible component. Natural starch is somewhat soluble in water, and as such can aid in disintegration of the appliance during use. In one embodiment, when quick, temperature-based disintegration of the dispersible component is desired, it may be beneficial to increase the amount of natural starch in the ingredients used to make the dispersible component.

In general, the ingredients used to make the dispersible component—in this case an extruded foam—can include between about 2% and about 10% natural starch. In one embodiment, the ingredients can include about 3.8% by weight natural starch. In addition to affecting disintegration characteristics of the dispersible component of the health-and-hygiene appliance, natural starch has inherent expansion characteristics upon extrusion and can also help give the foam a fairly rigid structure.

The natural starch used can be any starch of natural or plant origin. For example, starch extracted from plants such as corn, wheat, potato, rice, sorghum, tapioca, or various grains can be used. Generally, a natural starch can be granulated into particles before it is mixed with the other ingredients of the dispersible component of the health-and-hygiene appliance. For example, natural starch can be granulated into particles having an average particle diameter of less than about 100 micrometers prior to being mixed with the other ingredients used to form the dispersible component. In one embodiment, the starch can be granulated to an average particle diameter of between about 40 micrometers and about 90 micrometers.

The dispersible component of the health-and-hygiene appliance can also contain a nucleating agent. Nucleating agents are small particulate materials which can initiate the development of air cells and can help to control the cell size formed in the foam (when an extruded foam is used as the dispersible component). A nucleating agent can also improve the texture of the foam and provide the dry foam with a smoother surface. In general, the ingredients used to form the dispersible component can include about 5% and about 10% by weight nucleating agent. In one embodiment, the mixture can be about 7.7% nucleating agent. In one embodiment, a nucleating agent can be a food-grade talc. For example, food-grade talc having an average particle diameter of less than about 300 micrometers can be used. In one embodiment, talc having an average particle diameter between about 50 and about 200 micrometers can be used. The nucleating agent need not be food-grade talc, for example, in one embodiment, the nucleating agent can be any grade talc.

Optionally, the dispersible component can include destructured starch. The destructured starch component of the dispersible component can be from any starch of natural or plant origin which is composed essentially of amylose and/or amylopectin. The starch can be extracted from any suitable plant, such as, for instance, potatoes, rice, maize, tapioca, or various cereals, such as rye, wheat, oats, etc. Chemically modified starches and starches of different genotypes can also be used, if desired. Additionally, ethoxy derivatives of starch, starch acetates, cationic starches, oxidized starches, cross-linked starches and the like may also be used. The destructured starch which is added to the ingredients used to form the dispersible component can have an average particle size of any suitable diameter. For example, the destructured starch can have an average particle size greater than about 300 micrometers. In one embodiment, the destructured starch can have an average particle diameter between about 300 micrometers and about 1 millimeter.

Destructured starch can become highly cross-linked in the dispersible component and can aid in maintaining the open structure of the extrudate after expansion (when the dispersible component is an extruded foam). Being highly cross-linked, it can also be more resistant to dissolution in water than natural starch, and can be slower to disintegrate than other ingredients in the dispersing component. As such, the greater the amount of destructured starch in the dispersible component, in this case an extruded foam, the slower the foam can disintegrate. Therefore, when producing a health-and-hygiene appliance in which a longer duration of scrubbing prior to disintegration is desired, it may be beneficial to increase the amount of destructured starch in the ingredients used to form the dispersible component (e.g., in the ingredients used to extrude a foam). Additionally, as the dispersible component breaks down and disintegrates during scrubbing, small particles of destructured starch can maintain their integrity. The greater the amount of destructured starch in the dispersible component, the larger and more numerous these remaining particles can be. As such, certain embodiments of the invention, in which a more abrasive health-and-hygiene appliance is desired, can include relatively high levels of destructured starch in the dispersible component.

When the dispersible component is an extruded foam, up to about 25% by weight of the ingredients in the extruder can be destructured starch, depending on the characteristics desired in the final health-and-hygiene appliance. In one embodiment, the ingredients in the extruder can comprise between 0% and about 23% destructured starch. In one embodiment the ingredients in the extruder can include about 20.3% destructured starch.

Other additives can also be included in the health-and-hygiene appliance of the present invention as desired. For example, dyes, emollients, fragrance, oils, vitamins, pH adjusters, antimicrobial agents, antioxidants, and the like can be included in the dispersible component, the releasable component, or both. As stated elsewhere in the present application, employing such ingredients in the releasable component, which is applied or associated with the formed dispersible component, provides for greater flexibility in the selection of these ingredients, in that they need not withstand the more rigorous processing conditions that may be used in some versions of processes for forming the dispersible component (e.g., extruding). In addition, certain embodiments of the invention can include various additives to increase the abrasiveness of the health-and-hygiene appliance. For example, abrasive enhancing particulates, such as microspheres or other granules such as pumice or silica can be included in the appliance, whether in the dispersible component, the releasable component, or both.

Microspheres can be from about 10 micrometers to about 1 mm in diameter and typically have a shell thickness of from about 1 to about 5 micrometers, while macrospheres (which can also be used in some embodiments) can have diameters greater than about 1 mm. Such materials can include microbeads of metal, glass, carbon, mica, quartz or other minerals, plastic such as acrylic or phenolic, including acrylic microspheres known as PM 6545 available from PQ Corporation of Pennsylvania, and hollow microspheres such as the cross-linked acrylate SunSpheres™ of ISP Corporation (Wayne, N.J.) and similar hollow spheres as well as expandable spheres such as Expancel® microspheres (Expancel, Stockviksverken, Sweden, a division of Akzo Nobel, Netherlands), and the like.

The health-and-hygiene appliance can also be formulated with additives which can change the characteristics of the product as it disintegrates. For example, encapsulated additives can be added. Encapsulated additives can be released as a function of time, temperature, and/or pressure during use of the appliance. Possible encapsulated additives can include, for example, dyes, emollients, or fragrances. Additionally, time-delayed additives which possess an interval for change after contact with a liquid, such as water, can be included such that an appliance characteristic such as the color or the fragrance, for example, change as the appliance disintegrates with use. The trigger for such time-delayed changes can be tied to changes encountered during use such as, for instance, temperature changes, pressure variations, pH changes, mixing of different components during scrubbing, and the like.

In one embodiment of a dispersible component, in this case an extruded foam, the ingredients used to form the dispersible component are added to the extruder to form a dispersible component that includes between 0% to about 25% destructured starch, about 20% to about 65% by weight dextrin, about 5% to about 10% by weight ethanol, about 5% to about 10% by weight food-grade talc, about 5% to about 10% by weight polyvinyl alcohol, about 2% to about 10% by weight natural starch, and up to about 5% by weight fragrance.

Other dispersible components may be used, so long as the component is capable of supporting (i.e., act as a carrier of) the releasable component, and is adapted to disperse or disintegrate in response to pressure, a liquid, etc., thereby making available the releasable component of the health-and-hygiene appliance. For example, a dispersible component may be prepared by baking or heating various ingredients in, for example, molds to produce a substrate adapted to disintegrate or disperse in water. Alternatively, various ingredients may be mixed together and then used to generate a foam by, for example, vigorously mixing or agitating the ingredients. The resulting foam may then be dried, thereby producing a substrate adapted to disintegrate or disperse in water. Furthermore, while the present invention encompasses making both the dispersible component and the releasable component, commercially available materials may be acquired and combined to make a health-and-hygiene appliance of the present invention. For example, a packaging peanut or puff, available from American Excelsior Company and/or National Starch and Chemical Company and/or other distributors and sold under the name ECO-FOAM may be employed as a dispersible component. Other such packaging materials that are water-soluble are available commercially and may be used as the dispersible component.

Representative Version(s) of Processes for Forming a Dispersible Component

FIG. 1 illustrates one possible embodiment of a process for forming the dispersible component of a health-and-hygiene appliance of the present invention. In this embodiment—a process for forming a foamed material by extrusion, the ingredients that can be expanded via the extruder 104 can first be combined in a mixer 102. Any suitable mixer can be used to combine the dispersible-component ingredients. For example, in one embodiment a double-ribbon mixer 102, as illustrated in FIG. 1, can be used. Other styles of mixers could alternatively be used, however. For example, a food mixer such as those sold by the Hobart® corporation could be used. In one embodiment, a Hobart® Model A120-2 mixer can be used to mix the ingredients of the dispersible component prior to the mixture being fed to an extruder. Alternatively, a separate mixing step can be avoided, and the components can be added directly to the extruder for mixing within the extruder itself prior to expansion at the nozzle.

There is no particular order by which the components must be added to the mixer or the extruder. The mixer can be run at ambient temperature for a long enough period to thoroughly mix all of the components. For example, the ingredients of the dispersible component can be mixed in the mixer 102 for a time between about 1 minutes and about 15 minutes to obtain the desired extruder feed. The extruder feed can usually be quite dry. For example, the extruder feed can have a moisture content of between about 4% and about 10%. In one embodiment, the extruder feed can have a moisture content of between about 7.24% and about 7.41%.

The extruder feed can usually be fed through the extruder 104 by means of a screw feed, though this is not required in this version of a process for forming a dispersible component. For example, the extruder can be a single-screw extruder such as those available from the Randcastle Corporation, or a twin-screw extruder such as those available, for example, from the Wanger or Brabender Corporations.

In one embodiment, a twin-screw extruder, such as, for example, a conical twin-screw extruder, can be used. A conical twin-screw extruder can thoroughly mix the feed and provide a foam with a very uniform structure.

When a screw extruder is used for the present process, whether a single- or twin-screw extruder is used in preparing a dispersible component, the screw speed can generally be between about 50 and about 250 rpm, more specifically between about 100 and about 200 rpm. The residence time of the mixture in the extruder can be between about 15 seconds and about 2 minutes.

Typically, an extruder can be described with four zones, a feed zone, a metering zone, a mixing zone and a die section. In the present invention, the feed zone can generally have a temperature of between about 80° C. and about 145° C., more specifically about 100° C. The remaining zones can be at a higher temperature, such as between about 100° C. and about 175° C. Higher temperatures than about 175° C. could cause components of the foam to char and should be avoided. In one embodiment, the temperature at the nozzle 106 of the extruder can be about 165° C. As the mixture passes through the extruder, it becomes pressurized to between about 300 psi and about 1500 psi. Once the mixture exits the hot extruder and enters into ambient temperature and pressure, it can expand and form a foam.

The amount of expansion obtained in the foam upon exit from the extruder can depend upon a combination of several factors. For example, the amount of the blowing agent added to the mixture can affect the amount of expansion. Additionally, the amount of the other components added to the mixture, the temperature and pressure profile of the extruder, and the extruder-screw speed can all affect expansion characteristics of the foam. Greater expansion in the foam as it exits the extruder tends to provide a dispersible component with more complete disintegration upon use, i.e., a single-use sized product which can disintegrate and leave little or no particles of product when combined with water and scrubbing action for a period of time.

In those embodiments wherein the extruder nozzle 106 is round, expansion values can be obtained merely by comparing the nozzle diameter to the foam diameter after expansion. Equivalent means can be utilized for other nozzle shapes. Generally, the dispersible component of the health-and-hygiene appliance of the present invention can exhibit at least about 140% expansion upon extrusion. In one embodiment, the dispersible component can exhibit between about 140% and about 550% expansion upon extrusion (when, as noted elsewhere, an extrusion process is used to form the dispersible component).

Figure 2A:
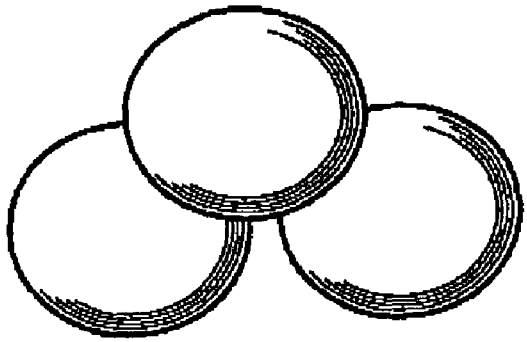
FIGS. 2*a*, 2*b*, and 2*c* are examples of possible embodiments of the present invention.
Figure 2B:
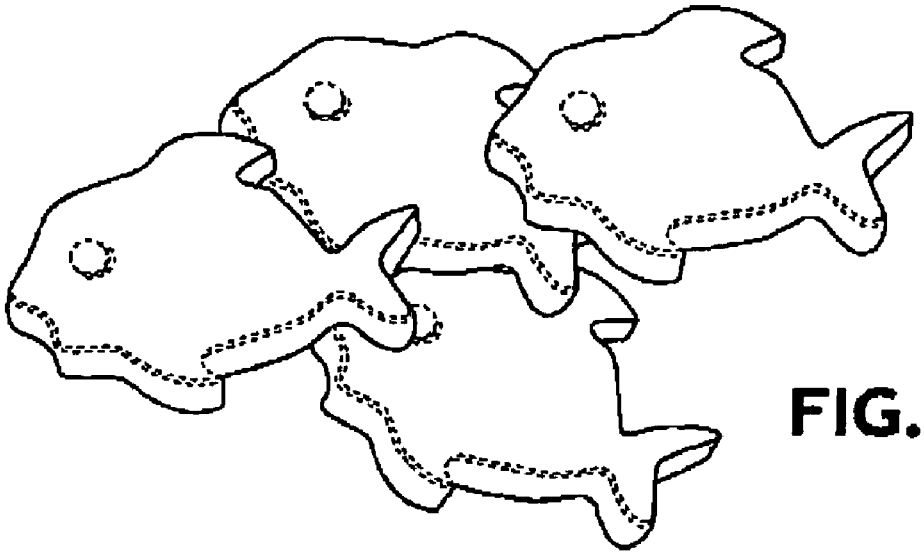
Figure 2C:
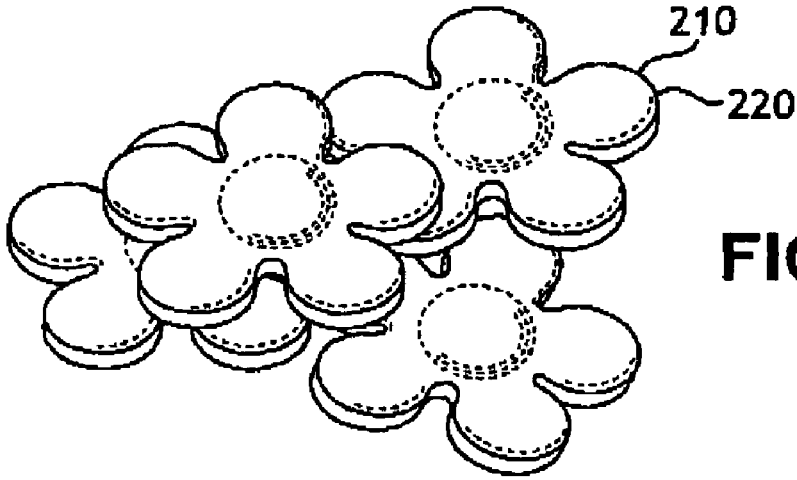
Figure 3A:
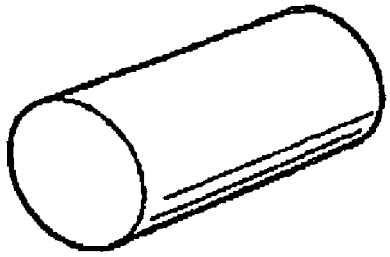
FIGS. 3*a*, 3*b*, 3*c* and 3*d* are examples of possible embodiments of the present invention.
Figure 3B:
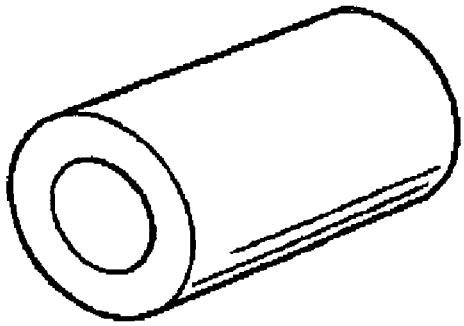
Figure 3C:
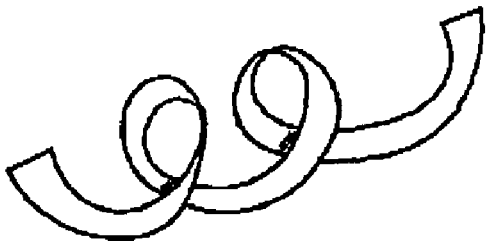
Figure 3D:
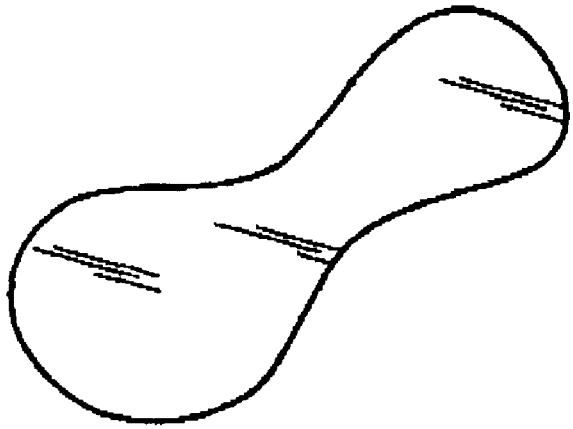

The nozzle 106 of the extruder can be any desired shape and can be designed to produce a dispersible component of any desired shape. For example, the nozzle 106 can be a slot, such as can produce a flat sheet of extrudate. The final dispersible-component shape can then be punched, cut, or otherwise formed from the extrudate, producing a flat dispersible component having the desired shape. If desired, in such an embodiment, additional details or shaping can be added using any known figure-shaping process, such as, for example, an embossing process. The flat fish figure illustrated in FIG. 2B and the flowers shown in FIG. 2C illustrate two possible embodiments of relatively flat product shapes, though any shapes could be formed: stars, moons, sun, clouds, animals, letters, cartoon characters, just to name a few. Additional representative versions are depicted in FIGS. 3A (a cylinder), 3B (a hollow cylinder), 3C (a twisted or curlicue shape), and 3D (a peanut shape). Note that such additional details may be added to the dispersible component prior to the application or association of the releasable component to the dispersible component; or during such application or association; or after such application or association.

Alternatively, when an extrusion process is used to form the dispersible component, the extruder nozzle 106 could have a more complex cross-sectional shape, and the final shape of the dispersible component could be formed by merely slicing the extrudate into the desired lengths as it exits the extruder. Additional molding of the extrudate can also be done to produce more complex, three-dimensional shapes, as desired. For example, spheres, such as those illustrated in FIG. 2A could be formed. Three-dimensional shapes could also be formed using other known processing techniques, such as, for example injection-molding processing techniques. Any desired shapes could be formed. For example, the health-and-hygiene appliances could resemble common items such as food products, for instance popcorn or candy, crayons, clouds, cotton balls, and the like. Note that such additional molding may be accomplished prior to the application or association of the releasable component to the dispersible component; or during such application or association; or after such application or association. Generally such molding will be done prior to the addition of the releasable component.

In one embodiment of the present invention, several individual-sized health-and-hygiene products can be combined together to form one large conglomerate object. For example, several spherical products could be connected, such as with a small amount of water at the point of contact, to meld the pieces together to form a single combined arrangement to resemble, for example, a mass of interlocking soap bubbles or a cluster of grapes. A single individual product piece could then be pulled from the cluster when used to wash. The individual shapes, for example individual 'bubbles' or 'grapes' could additionally be of a variety of colors and fragrances, characteristics which could either be apparent when the appliance is dry or alternatively could become apparent only when the appliance becomes wet. More complex shapes could also be formed of multiple different shapes attached together, such as large flowers, animals, or the like, from which a single piece can be pulled off for washing.

In one embodiment of the present invention, a co-extrusion process can be used, and the dispersible component thus produced can be a multi-zone dispersible component with one zone of a different material than other zones. For example, a dispersible component can be produced in a desired shape, such as a flower as illustrated in FIG. 2C, with the outer zone of the flower 210 one type of extrudate, and the inner zone of the flower 220 an extrudate of different characteristics, such as a different color, for example. Alternatively, one of the zones could be formed of a different material altogether, other than the foam extrudate of a dispersible component of a health-and-hygiene appliance of the present invention. In one embodiment, as the two zones disintegrate and their components mix during scrubbing, characteristics of the product, such as the color and/or fragrance, for example, could change.

Other processes for preparing dispersible components may be used, so long as the resulting component is capable of supporting (i.e., act as a carrier of) the releasable component, and is adapted to disperse or disintegrate in response to pressure, a liquid, etc., thereby making available the releasable component of the health-and-hygiene appliance.

Representative Version(s) of a Releasable Component

Releasable components, e.g., cleaning compositions or formulations, that may be deposited, coated, sprayed, printed, injected on or otherwise associated with the dispersing component of a health-and-hygiene appliance of the present invention include soaps, skin lotions, colognes, sunscreens, shampoos, gels, bodywashes, and the like. Such compositions may be in solid, liquid, or gel or other forms. Such compositions may also include, or be, moisturizing agents or formulations. Furthermore, these examples of releasable components may be employed with binders (e.g., waxes) or other ingredients that help attach said releasable component to the dispersing component. It should be noted that when the releasable component employs liquid or water in an amount that would degrade or disperse the dispersible component, then the dispersible component must be segregated from such liquid or water prior to use of the corresponding health-and-hygiene appliance. Otherwise the dispersible component will degrade, disintegrate, or disperse prior to use of the appliance. Such liquid or aqueous ingredients may be, as is discussed elsewhere, encapsulated to prevent premature contact between the liquid or water and the dispersible component.

Alternatively, the ingredients may be supplied in substantially dry form, thereby minimizing or preventing premature contact and dispersal or disintegration of the dispersible component.

Many cleaning compositions contain similar core ingredients such as surfactants. They may also contain oils, detergents, emulsifiers, film formers, waxes, perfumes, preservatives, emollients, solvents, thickeners, humectants, chelating agents, stabilizers, pH adjusters, and so forth. In U.S. Pat. No. 3,658,985, for example, an anionic based composition contains a minor amount of a fatty acid alkanolamide. U.S. Pat. No. 3,769,398 discloses a betaine-based composition containing minor amounts of nonionic surfactants. U.S. Pat. No. 4,329,335 also discloses a composition containing a betaine surfactant as the major ingredient and minor amounts of a nonionic surfactant and of a fatty acid mono- or di-ethanolamide. U.S. Pat. No. 4,259,204 discloses a composition comprising 0.8 to 20% by weight of an anionic phosphoric acid ester and one additional surfactant which may be either anionic, amphoteric, or nonionic. U.S. Pat. No. 4,329,334 discloses an anionic amphoteric based composition containing a major amount of anionic surfactant and lesser amounts of a betaine and nonionic surfactants.

U.S. Pat. No. 3,935,129 discloses a liquid-cleaning composition containing an alkali metal silicate, urea, glycerin, triethanolamine, an anionic detergent and a nonionic detergent. The silicate content determines the amount of anionic and/or nonionic detergent in the liquid-cleaning composition. U.S. Pat. No. 4,129,515 discloses a liquid detergent comprising a mixture of substantially equal amounts of anionic and nonionic surfactants, alkanolamines and magnesium salts, and, optionally, zwitterionic surfactants as suds modifiers. U.S. Pat. No. 4,224,195 discloses an aqueous detergent composition comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient. Detergent compositions containing all nonionic surfactants are shown in U.S. Pat. Nos. 4,154,706 and 4,329,336. U.S. Pat. No. 4,013,787 discloses a piperazine based polymer in conditioning and shampoo compositions. U.S. Pat. No. 4,450,091 discloses high viscosity compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. U.S. Pat. No. 4,595,526 describes a composition comprising a nonionic surfactant, a betaine surfactant, an anionic surfactant and a C12-C14 fatty acid mono-ethanolamide foam stabilizer. The contents of the patents discussed herein are hereby incorporated by reference as if set forth in their entirety and in a manner consistent herewith.

Further information on these ingredients may be obtained, for example, by reference to: *Cosmetics & Toiletries*, Vol. 102, No. 3, March 1987; Balsam, M. S., et al., editors, *Cosmetics Science and Technology,* 2nd edition, Vol. 1, pp 27-104 and 179-222 Wiley-Interscience, New York, 1972, Vol. 104, pp 67-111, February 1989; *Cosmetics & Toiletries*, Vol. 103, No. 12, pp 100-129, December 1988, Nikitakis, J. M., editor, *CTFA Cosmetic Ingredient Handbook*, first edition, published by The Cosmetic, Toiletry and Fragrance Association, Inc., Washing-ton, D.C., 1988, Mukhtar, H, editor, *Pharmacology of the Skin*, CRC Press 1992; and Green, F J, *The Sigma-Aldrich Handbook of Stains. Dyes and Indicators*; Aldrich Chemical Company, Milwaukee Wis., 1991, the contents of which are hereby incorporated by reference as if set forth in their entirety and in a manner consistent herewith.

Exemplary materials that may be used in the practice of this invention further include but are not limited to those discussed in *Cosmetic and Toiletry Formulations* by Ernest W. Flick, ISBN 0-8155-1218-X, second edition, section XII (pages 707-744).

Other ingredients that may be included in a composition or formulation of a releasable component of a health-and-hygiene appliance of the present invention include emulsifiers, surfactants, viscosity modifiers, natural moisturizing factors, antimicrobial actives, pH modifiers, enzyme inhibitors/inactivators, suspending agents, pigments, dyes, colorants, buffers, perfumes, antibacterial actives, antifungal actives, pharmaceutical actives, film formers, deodorants, opacifiers, astringents, solvents, organic acids, preservatives, drugs, vitamins, aloe vera, some combination thereof, and the like.

When the releasable component is a soap or other formulation to be delivered to the user of the health-and-hygiene appliance as the dispersible component disintegrates or disperses, the soap or other formulation can be any such material designed or chosen with a specific health-and-hygiene use in mind. For instance, any desired formulation ranging from an aggressive, antiseptic soap as is used in a clinical setting, to a gentle, mild detergent for use on sensitive skin, can be delivered to the user as the dispersible component disintegrates. For example, the releasable component can be a soap such as a fatty-acid soap. Alternatively, the releasable component can be any other detergent known to be applicable in health-and-hygiene and/or personal-cleansing products. For example, surfactant systems as are known in the art can be used as the desired releasable component. Possible surfactants or surfactant systems can include known anionic, nonionic, zwitterionic or amphoteric surfactants. In one embodiment, synthetic detergent preparations can be used as the releasable component. For instance, synthetic detergent systems including sodium cocoyl isethionate, sold as Jordapon® CL prilled isethionate surfactants available from the BASF Corporation, sodium dodecylbenzene sulfonate, sold under the name Nacconol® by the Stepan Company, or sodium olefin sulfonate sold as Bio-Terge® obtainable from the Stepan Company, can be suitable releasable components in a health-and-hygiene appliance of the present invention. As desired, either a single soap, surfactant, or formulation can be used, or alternatively a combination of different soaps, surfactants, or formulations can be used together in the health-and-hygiene appliance.

Generally, the releasable component of the present invention can make up from about 10% to about 75% by weight of the total weight of the health-and-hygiene appliance; suitably between about 20% and about 60% by weight of the total weight of the health-and-hygiene appliance). More specifically, the releasable component of the health-and-hygiene appliance can be from about 15% to about 25% by weight of the total weight of the health-and-hygiene appliance. In one embodiment, the health-and-hygiene appliance can include about 22.1% by weight of the releasable component. It should be noted that other ratios of the weight of the releasable component to the weight of the dispersible component are possible, depending on, for example, the densities of each of these components; the selected volume of the dispersible component (e.g., a larger shape that is easily handled by children); etc.

Representative Process(s) for Preparing and Applying a Releasable Component to the Dispersible Component As with the dispersible component, any suitable mixer can be used to combine the ingredients used to make the releasable component. For example, a food mixer such as those sold by the Hobart® corporation could be used. In one embodiment, a Hobart® Model A120-2 mixer can be used to mix the ingredients of the releasable component prior to the mixture being associated with the dispersible component. Alternatively, the ingredients of the dispersible component need not be mixed prior to their association with the dispersible component. For example, the ingredients of the releasable component may be applied by spraying, coating, or depositing the ingredients separately onto a formed dispersible component.

There is no particular order by which the ingredients of the releasable component must be added to the mixer or applied to the dispersible component. If a mixer is used, it can be run at ambient temperature for a long enough period to thoroughly mix all of the components. Other temperatures may be used, so long as the temperature (and time of exposure of the ingredients to said temperature) does not damage, or impair the function of, the ingredients of the releasable component.

The releasable component can be applied as a coating to the outside of the dispersible component (e.g., an extruded foam; a biodegradable puff; etc.) in much the same manner as seasoning is applied to puffs when making Cheetos®-brand snacks. Examples of such process are disclosed in U.S. Pat. No. 4,576,108, entitled "Apparatus for Applying Viscous Seasoning to Tumbling Food Articles," reciting 18 Mar. 1996 as the date of the patent; U.S. Pat. No. 5,514,399, entitled "Method of Applying Particulates to Baked Goods and Snacks," reciting 7 May 1996 as the date of the patent; and U.S. Pat. No. 5,698,252, entitled "Topical Application of Particulates for Production of Reduced Fat, Low Fat, and No-Fat Baked Goods and Snacks," reciting 16 Dec. 1997 as the date of the patent. Each of these patents is incorporated by reference in its entirety in a manner consistent herewith. In one example of a process for applying a releasable component to a dispersible component, an oil-based slurry or dry powder (i.e., the releasable component) may be applied to the dispersible component, such as an extruded foam puff, in a rotating tumble-drum system. Conical in-feeds may be used to deliver the dispersible component into the drum. Generally this softens impact of the dispersible component and reduces fines. Oil, water, wax, fat, shea butter, or other material may be added to the dispersible component before, or concurrent to, being combined with the releasable component in a tumble-drum system. Such materials facilitate adherence of the releasable component to the surface of the dispersible component. Depending on the ingredients used, heat can be inputted into the system to dry the resulting health-and-hygiene appliance. Note too that a gum solution, starch solution, a water-soluble adhesive, a water-dispersible adhesive, a water-soluble hot-melt adhesive, maltodextrin or other non-oil-based binder might be sprayed on or otherwise applied to the dispersible component before or concurrent to being combined with the releasable component (see, e.g., U.S. Pat. Nos. 5,700,344; 5,753,724; and 6,365,680 B1; each of which is incorporated by reference in its entirety in a manner consistent herewith). Such a binder might include materials like gum Arabic, other hydrocolloids, and/or maltodextrin. Such binders may be added in powder or liquid form. Again, as stated earlier, after such binder has been added to the dispersible component, and the treated dispersible component combined with the releasable component in, for example, a tumble-drum or other contacting system, the resulting combination may be dried. Furthermore, any liquid or water added to the dispersible component as part of the process for adhering or attaching the releasable component to the dispersible component may disperse or disintegrate the outer portion of the dispersible component, thereby helping facilitate adherence of the releasable component to the dispersible component.

Alternatively, the releasable component, or some portion thereof, can be placed in an internal cavity a dispersible component. Waxes, binders, or even water can be used to help secure the releasable component to the dispersible component.

Representative Package(s) for a Health-and-Hygiene Appliance of the Present Invention The manufacturer of a health-and-hygiene appliance of the present invention may fashion messages, statements, or copy to be transmitted to a purchaser, consumer, or user of said appliance. Such messages, statements, or copy may be fashioned to help facilitate or establish an association in the mind of a user of the appliance between an appliance of the present invention, or use thereof, and one or more mental states, psychological states, or states of well being. The communication, statements, or copy may include various alphanumeric strings, including, for example: relax, peace, energy, energize, spa, spirit, spiritual, clean, fresh, mountain, country, zest, sea, sky, health, hygiene, water, waterfall, moisture, moisturize, scent, convenient, single, child, hygiene, derivatives or combinations thereof, or other such words or states. In one embodiment, the communication, statements, or copy create a mental association in the mind of the consumer between a health-and-hygiene appliance of the present invention and good hygiene habits, including, for example, good hygiene habits in children. In another embodiment, the communication, statements, or copy create a mental association in the mind of the consumer between a health-and-hygiene appliance of the present invention and a spa or spa-related experience. In another embodiment, the communication, statements, or copy create a mental association in the mind of the consumer between a health-and-hygiene appliance of the present invention and the fact that the appliance is adapted for a single use. In another embodiment, the communication, statements, or copy create a mental association in the mind of the consumer between a health-and-hygiene appliance of the present invention and a registered or common-law trademark of the seller, manufacturer, and/or distributor of the appliance. In another embodiment, the communication, statements, or copy create a mental association in the mind of the consumer between a health-and-hygiene appliance of the present invention and an animated character.

Messages, copy, statements, and/or alphanumeric strings like those referred to above may be used either alone, adjacent to, or in combination with, other alphanumeric strings. The communication, statements, message, or copy could take the form of (i.e., be embodied in a tangible medium such as) a newspaper advertisement, a television advertisement, a radio or other audio advertisement, items mailed directly to addressees, items emailed to addresses, Internet Web pages or other such postings, free standing inserts, coupons, various promotions (e.g., trade promotions), co-promotions with other companies, copy and the like, boxes and packages containing the product (in this case an appliance of the present invention), and other such forms of disseminating information to consumers or potential consumers. Other exemplary versions of such communications, statements, messages, and/or copy may be found in, for example, U.S. Pat. Nos. 6,612,846 and 6,896,521, both entitled "Method for Displaying Toilet Training Materials and Display Kiosk Using Same"; co-pending U.S. application Ser. No. 10/831,476, entitled "Method of Enunciating a Pre-Recorded Message Related to Toilet Training in Response to a Contact"; co-pending U.S.

application Ser. No. 10/956,763, entitled "Method of Manufacturing and Method of Marketing Gender-Specific Absorbent Articles Having Liquid-Handling Properties Tailored to Each Gender"; each of which is incorporated by reference in their entirety in a manner consistent herewith.

It should be noted that when associating statements, copy, messages, or other communications with a package (e.g., by printing text, images, symbols, graphics, color(s), or the like on the package; or by placing printed instructions in the package; or by associating or attaching such instructions, a coupon, or other materials to the package; or the like) containing appliances of the present invention, the materials of construction of said package may be selected to reduce, impede, or eliminate the passage of water or water vapor through at least a portion of the package, thereby helping to minimize or prevent premature dispersal or disintegration of the dispersing component prior to use of the health-and-hygiene appliance.

As noted above, some embodiments of the present invention comprise a cleaning composition, moisturizing composition, some combination thereof, and the like. Such compositions may contain water. Therefore packages, containers, envelopes, bags, and the like that reduce, minimize, or eliminate the evaporation or transmission of water or water vapor from appliances contained therein may be beneficial. Furthermore, appliances may be individually wrapped in containers, packets, envelopes, bags, wrappers, or the like that inhibit, reduce, or eliminate the passage or transmission of water or water vapor from appliances contained therein. Furthermore, because the dispersible component may be adapted to disintegrate or disperse upon exposure to a liquid or vapor, such as water or water vapor, these same containers may be used to reduce or eliminate the passage of water into any associated packaging such that the appliances contained therein begin to degrade prematurely. For purposes of this application, "packages," "containers," "envelopes," "bags," "packets," and the like are interchangeable in the sense that they refer to any material adapted to enclose and hold either individual appliances (as in, for example, an individual packet containing a single appliance), or a plurality of appliances (as in a flexible bag made of film containing a plurality of appliances, whether or not each of the individual appliances are enclosed and held in a separate material—such as individual packets).

In some embodiments of the present invention, a package will contain not only one or health-and-hygiene appliances of the present invention, but other personal-care products. In one embodiment, a health-and-hygiene appliance of the present invention is sold, transferred, distributed, or marketed with other products directed to personal-care, especially products directed to cleaning, moisturizing, or otherwise caring for a user's skin. For example, a health-and-hygiene appliance of the present invention can be sold, transferred, distributed, or marketed with a personal-care appliance for moisturizing a user's skin (e.g., hand, foot, forearm, or other locations on a user's body). A co-pending U.S. patent application (U.S. patent application Ser. No. 11/190,597) entitled "Appliance for Delivering a Composition," filed on 26 Jul. 2005 to K. Close et al., describes such appliances, including socks comprising compositions for moisturizing feet, and gloves comprising compositions for moisturizing hands. This application is hereby incorporated by reference in its entirety in a manner consistent herewith. In another version of the invention, a health-and-hygiene appliance of the present invention is sold with a two-sided personal-care appliance, such as a pad having a surface or face primarily for exfoliating skin, and an opposing surface or face primarily for cleaning or moisturizing skin. A co-pending U.S. patent application (U.S. patent application Ser. No. not yet assigned; internal docket number K-C 21998) entitled "Two-Sided Personal Care Appliance for Health, Hygiene, And/Or Environmental Application(s); And Method of Making Said Two-Sided Personal-Care Appliance," filed on 1 Nov. 2005 to K. Close et al., describes such appliances, including an exfoliating foot buff. This application is hereby incorporated by reference in its entirety in a manner consistent herewith. Other combinations of such personal-care products and health-and-hygiene appliances are possible and within the scope of the present invention. It should be noted that such combinations may be marketed and packaged as described in the preceding paragraphs. In one version of the invention, these combinations are marketed in such a way that the design, function, and/or appearance of the individual products making up the combination are related to a common theme. One theme, for example, may be that each product provides a spa-like, or spa-related, treatment or experience for the user of the products. "Spa-like" or "spa-related" relates or refers to a fashionable and/or beneficial treatment or experience analogous to a treatment or experience a guest might receive at a resort, hotel, or other such establishment where a person is refreshed, seeks relaxation, seeks beneficial treatments of his or her skin, hair, muscles, finger nails, toe nails, face, or other parts of the body, and the like.

Reference now will be made to various embodiments of the invention, examples of which are set forth below. Each example is provided by way of explanation of the invention, not as a limitation of the invention. In fact, it will be apparent to those skilled in the art that various modifications and variations can be made of this invention without departing from the scope or spirit of the invention.

EXAMPLE 1

The dispersible component, ten ECO-FOAM-brand loose-fill packing puffs (i.e., water-soluble, degradable, extruded corn-starch puffs made by National Starch and Chemical Company) were weighed and then misted with water as a group using an Oil-O-Pump mister (available from Gemco as product number 7925). These puffs were cylindrically shaped, having a length of about 1.5 inches, a diameter of about 0.5 inches, and a calculated volume of about 0.3 cubic inches. The resulting ECO-FOAM puffs, having water-dampened surfaces—with the water beginning to interact with the chemical constituents of the puffs themselves—were sticky and therefore capable of adhering to a soap coating. The dry weight of the puffs was 1.38 g; the misted weight was 1.45 g.

The ten water-misted ECO-FOAM puffs were then placed in a one-gallon Ziplock bag that contained about 2.5 g of a mixture of surfactants and colorant (i.e., the cleaning formulation or cleaning formulation). This particular cleaning formulation included, by dry weight (w/w; i.e., the weight of the ingredient divided by the total weight of the mixture containing the ingredient): 83.22% NACCONOL-brand 90 G (surfactant, available from Stepan Corporation), 14.42% Jordapon CI prill (surfactant, available from BASF Corporation), 0.90% Mackol CAS-100N (emollient, available from McIntyre Group), and 1.46% D&C Red #27 AI Lake (colorant, CAS 13473-26-2, CI 45410:2, available from LCW, a Sensient Company). The bag containing the ECO-FOAM puffs (dispersible component) and the cleaning formulation (releasable component) was sealed and then shaken to coat the puffs. The puffs clumped together to form a loose ball. The cleaning formulation also agglomerated and coated the ECO-FOAM puffs unevenly. The total weight of the ten coated soap puffs was 2.48 g.

The coated puffs (i.e., representative versions of a health-and-hygiene appliance of the present invention) were separated. The uneven coating gave them a spotted appearance that was due to uneven application of the water mist to the puffs. On average each puff was coated with about 0.10 g of the cleaning formulation; the releasable component made up 42% of the total weight of the product/appliance immediately after coating. Note that, in some instances, a uniform application of binder and/or releasable component may be desired. In other instances, a nonuniform application may be desired (e.g., a red soap-powder mix or cleaning formulation attached to the exterior surface of a green extruded-foam cylinder).

The resulting appliance was tested in a sink. The appliance dissolved on wetting leaving the cleaning-formulation components behind to create a pink lather during washing. A minor amount of residue remained in the sink after washing.

EXAMPLE 2

The same materials and processing steps used in Example 1 were used in this example except that each ECO-FOAM packing puff was individually misted with water and individually coated with the cleaning formulation. The average dry weight of each puff before misting was 0.12 g; the average weight of each puff after misting with water was 0.17 g; and the average weight of the misted puffs after application of the cleaning formulation (i.e., the coated weight) was 0.37 g. A more uniform coating was obtained, with the resulting coating of cleaning formulation on each ECO-FOAM puff averaging about 0.20 g. The releasable component was 68% of the total weight in the moistened state and 54% based on the total dry weight.

EXAMPLE 3

ECO-FOAM packing puffs (dispersible component) were coated in canola oil with a variety of methods. Canola oil was used since it did not dissolve the ECO-FOAM puffs. Individual, canola-oil-treated, ECO-FOAM puffs were then placed in a Styrofoam cup containing an excess of the cleaning formulation (releasable component) of Example 1. A lid was placed over the cup and the contents shaken to coat the ECO-FOAM puff. The appliance was then removed and the process repeated. The table below shows the results of various coating methods.

| Method | Foam (g) | Foam + Oil (g) | Foam + Oil + Cleaning Formulation (g) | % Coating wt to total wt. | % Cleaning Formulation wt to total wt. |
|---|---|---|---|---|---|
| Dip & Coat[1] | 0.14 | 2.66 | 3.37 | 93% | 21% |
| Dip & Coat[1] | 0.12 | 1.01 | 1.27 | 91% | 20% |
| Dip, Blot off & Coat[2] | 0.13 | 0.94 | 1.19 | 89% | 21% |
| Blot on & Coat[3] | 0.12 | 0.23 | 0.32 | 63% | 28% |

[1]The foam puff was immersed in the canola oil, drained, and then coated with the cleaning formulation. Draining time varied in the two examples.
[2]The foam puff was immersed in the canola oil, drained, excess oil blotted off, and then coated with the cleaning formulation.
[3]A paper towel, saturated with canola oil, was used to blot the oil onto the surface of the foam puff. The coated foam puff was then coated with the cleaning formulation.

EXAMPLE 4

Uniform coatings of a releasable component on a dispersible component were obtained by first applying a shea butter (Lipex 102 Butyrospermum Fruit) to an ECO-FOAM puff before subsequently coating the puff with the dry cleaning formulation of Example 1. Unlike water, shea butter did not begin dissolving the puff. Furthermore, unlike oils, shea butter adheres to the puff and does not have a greasy feel or appearance like, for example, canola oil. Note also that shea butter, while serving in part as a binder, can also serve as an emollient, thereby offering other skin-health benefits.

ECO-FOAM packing puffs (dispersible component) were individually and gently rolled across a layer of the Shea Butter several times without crushing the puffs. The ends of each puff were also coated by gently pressing them into the Shea Butter with a rocking motion. The coated dispersible component was then placed in a Styrofoam cup containing an excess of the cleaning formulation of Example 1 (releasable component). A lid was place over the cup and the contents shaken to coat the ECO-FOAM peanut. The appliance was then removed and the process repeated. On average 0.09 g of Shea Butter and 0.33 g of cleaning formulation were deposited on the peanut. The total coating (shea butter and cleaning formulation) was 76% of the total appliance weight; the cleaning formulation was 60% of the total appliance weight.

The resulting appliance was tested in a sink. The appliance dissolved on wetting and the soap components produced a pink lather during washing.

EXAMPLE 5

The same materials and processing steps used in Example 4 were used in this example except that Raven Crackling Pops Code 1001 (Raven Manufacturing, LLC) were used in place of the cleaning formulation. Raven Crackling Pops create a popping sensation and auditory effect when exposed to water. Due to particle size the Crackling Pops coating was uneven. On average 0.07 g of shea butter and 0.29 g of Crackling Pops were deposited on the puff.

The resulting appliance was tested in a sink for a simulated hand washing. The appliance dissolved on wetting leaving the Crackling Pops behind. A popping and crackling sound could be heard on wetting when the hands were held close to the ear but was short in duration. An additional sound from rubbing the Crackling Pops together could also be heard. The Crackling Pops also dissolve more slowly than the dispersible component; their dissolution could be used to signal the completion of a hand-washing time interval.

This example demonstrates an auditory effect. A cleansing composition, such as the releasable component identified in Example 1 (i.e., the cleaning formulation) could be mixed with the Crackling Pops to create a releasable component for the appliance that has an auditory effect.

EXAMPLE 6

The same materials and processing steps used in Example 4 were used in this example except that the releasable component was a 95/5 (w/w) dry mix of the Naconal 90G surfactant (95% w/w) and an encapsulated, red, thermochromic dye (5% w/w) obtained from Chromatic Technologies, Inc. The dye changes from red to colorless at 31° C. On average 0.05 g of shea butter and 0.16 g of the surfactant/dye mix were deposited on the dispersible component.

The resulting red-colored appliance reversibly changed to white when handled (from body heat) and back to red when cooled. The appliance dissolved on washing and the color changed to a white lather.

This example demonstrates a color-changing cleansing appliance. Various thermochromic dyes with different transition temperatures could be selected to create multiple color transitions. Alternatively a thermochromic dye in the releasable coating can be used to mask another color in the releasable component to color the lather or underlying color in the dispersible component.

EXAMPLE 7

The same materials and processing steps used in Example 4 were used in this example except that the releasable component was a dry mix of 21.65 g of citric acid (Sigma-Aldrich) and 28.43 g of sodium bicarbonate (Sigma-Aldrich). This dry acid/base mixture will produce carbon dioxide gas and effervesce on contact with water. On average 0.06 g of shea butter and 0.36 g of the effervescent mix were deposited on the dispersible component.

The resulting appliance was tested in a sink for a simulated hand, washing. Immediate effervescence was observed on wetting as the dispersible component dissolved. A faint, short-lived, fizzing sound was also heard as the releasable component reacted with the water.

This example demonstrates an effervescent effect. A cleansing composition could employ ingredients such as the mixture of citric acid and sodium bicarbonate, or other effervescent ingredients or mixtures, to create a releasable component that bubbles and fizzes on, release from the dispersible component.

EXAMPLE 8

ECO-FOAM puffs (as described in Example 1) were filled with the cleaning formulation of Example 1. An internal cavity was created by inserting a ⅛" diameter glass rod into the end of the puff. A funnel was then created from a disposable transfer pipette (SAMCO Scientific transfer pipette Catalog #202) by cutting off half of the pipette's bulb for the funnel and cutting off part of the dispensing end to enlarge the neck of the funnel. The newly created funnel was then inserted into the puff cavity and the cleaning formulation loaded into the cavity. The hole to the cavity was then sealed by either dampening the hole with moisture and crimping it, or by plugging it with shea butter.

The average amount of cleaning formulation added to the internal cavity of the dispersible component was 0.18 g for the crimped sealing method and 0.15 g for the plug sealing method. About 0.07 g of shea butter was used to plug the cavity entrance.

The resulting appliance's contents could be seen in those areas in which the releasable component's pink soap mix in the cavity was close to the surface. The contents would likely not be seen in a hollow, dispersible component with a uniform, thicker, and/or colored wall. Accordingly, a health-and-hygiene appliance may be fashioned so that the releasable component cannot be observed visually until use, or, if desired, so that the contents may be detected visually through the wall of the dispersible component. One potential advantage of a filled health-and-hygiene appliance is that the releasable coating cannot rub off or disassociate from the appliance as readily prior to use.

EXAMPLE 9

The same materials and processing steps used in Examples 4 and 8 were used in this example to create an internally filled and externally coated appliance. A large cavity was created in the dispersible component (an ECO-FOAM puff as described in Example 1) and then loaded with 0.91 g of the effervescent mix from Example 7. The end of the appliance was sealed with 0.2 g of shea butter. The sealed appliance was then externally coated according to the method of Example 4 with the cleaning formulation of Example 1. Because the hollowed-and-filled puff was less rigid, rolling the puff to apply the shea butter was more difficult than rolling a non-filled puff.

The resulting appliance was tested in a sink. A light pink lather was created with washing as the appliance dissolved. A burst of effervescence and a slight cooling sensation was felt as the effervescent mixture reacted in the presence of water.

This example demonstrates the combination of two different releasable components to deliver a cleansing benefit as well as a visual and/or tactile effect.

EXAMPLE 10

The methods and materials used in Example 4 were used except a dry, 95/5 (w/w; i.e., denoting 95% by weight of Naconal 90 G and 5% by weight of Litmus) mixture of NACCONOL-brand 90 G and Litmus (Sigma-Aldrich) was used for the releasable component. The Litmus was ground into a fine powder before mixing with the NACCONOL-brand 90G surfactant. Litmus is an indicator that is red at low pH (4.5) and blue at high pH (8.3). The ground Litmus particles are dark grey in color and do not completely dissolve in water. Skin has a pH ~5.5 to 6. On average 0.09 g of Shea Butter and 0.27 g of the pH-sensitive mix were deposited on the dispersible component.

The resulting appliance was uniformly coated with the charcoal grey, releasable composition. The appliance dissolved on wetting, leaving the surfactant and Litmus components behind to create a grey-blue lather during washing. Although the lather did not turn pink from contact with the skin, the undissolved Litmus particles served as wash and rinse indicators. They marked the areas which had been covered during washing and which areas required further rinsing.

EXAMPLE 11

A Litmus/surfactant appliance of Example 10 was subsequently filled with citric acid using the filling method of Example 8. The resulting charcoal grey appliance had 0.23 g of the Litmus/NACCONOL-brand 90G releasable component and contained 0.13 g of citric acid (Sigma-Aldrich) as a second releasable component.

The appliance dissolved on wetting leaving surfactant and Litmus components behind to create a grey-blue lather that immediately turned pink when the citric acid was released during washing.

This example demonstrates a pH-induced color change using a pH indicator and a pH altering agent. Further controlling the release of the pH agent would delay the color change and could be used as a wash time signal. This may be accomplished through control of the dissolution rate of the dispersing component or further coating or encapsulating of the pH agent.

EXAMPLE 12

The methods and materials used in Example 4 were used except a dry, 95/5 (w/w) mixture of NACCONOL-brand 90 G and Carminic acid (Sigma-Aldrich) was used for the releasable component. Carminic acid is a pH-sensitive, water-soluble food dye also known as Natural Red 4 (CI 75470). Carminic acid has a deep red color in water that changes to yellow under acidic conditions.

The Carminic acid/surfactant appliance was subsequently filled with citric acid using the filling method of Example 8. The resulting dark red appliance had 0.21 g of the Carminic/Naconal 90G releasable component and contained 0.08 g of citric acid, a second releasable component.

The appliance dissolved on wetting leaving surfactant and Carminic acid components behind to create a dark red lather. The lather became bright orange after the citric acid was released during washing.

This example demonstrates a pH-induced color change using two different, but interactive (or reactive) releasable components. Separation of the releasable components permits the development of a wash time signal. Direct mixing of the releasable components permits an immediate color change.

More elaborate color-change systems can be envisioned by combining multiple change agents. For example the appliance might be charcoal grey, on wetting it immediately becomes pink from the reaction of citric acid mixed in the Litmus coating, on further washing it changes blue when a base such as sodium bicarbonate is further released after a time delay.

EXAMPLE 13

A red, thermochromic-dye-containing appliance made according to Example 6 was subsequently filled with a small amount of D&C Green #5 (Sensient Colors, Inc.) using the filling-and-plug-sealing methods of Example 8. On average the appliance contained 0.25 g of the first, thermochromic/surfactant releasable component and 0.007 g of the second, D&C Green #5, releasable component.

The resulting red-colored appliance reversibly changed to white when handled (from body heat) and back to red when cooled. The red appliance dissolved on washing and the color changed to a white lather. The white lather subsequently became blue when the second releasable component was released from the dispersible component.

This example demonstrates a 3-color-changing cleansing appliance (red, white, and blue) using releasable components that do not react with each other. The thermochromic dye reacts to temperature; the D&C Green #5 dye dissolves in water and colors the lather.

EXAMPLE 14

The same materials and processing steps used in Example 6 were used in this example except that a yellow, extruded product made according to Ribble et. al. in US 2004/0048759 A1 was used in place of the ECO-FOAM packing puff described in Example 1. The yellow, extruded product had an annular shape: with approximately a ⅝-inch outside diameter, approximately a ⅛-inch internal diameter, and approximately a ½-inch length. The yellow, extruded product contained a cleaning formulation within it (i.e., distributed substantially homogeneously throughout the dispersible component itself). On average 0.15 g of the red, thermochromic dye/NACCONOL-brand 90G mixture was deposited on the annulus.

The resulting red-colored appliance reversibly changed to yellow when handled (from body heat) and back to red when cooled. The red appliance turned yellow on wetting and delivered a white lather on washing. This appliance appeared to dissolve more slowly than an appliance from Example 6.

This example demonstrates an appliance in which cleaning compositions are present in both the releasable and dispersible components.

EXAMPLE 15

The methods and materials used in Example 4 were used except a dry, 95/5 (w/w) mixture of NACCONOL-brand 90 G and Fircaps-brand encapsulated fragrance (Firmenich) was used for the releasable component. The fragrance was contained in a starch-based encapsulate. The microcapsules rupture on contact with water and/or rubbing to release the fragrance. The Fircaps fragrance was Intelygence GHM 4690.910 and had a fragrance load of 40% by weight. On average 0.09 g of shea butter and 0.24 g of the Fircaps mix were deposited on the dispersible component.

The resulting appliance was tested in a sink. The appliance produced a faint burst of fragrance on wetting and dissolved to produce a white lather. The intensity of the fragrance could be increased by increasing the amount of Fircaps present.

This example demonstrates an olfactory effect. A variety of different fragrances could be used. The olfactory effect could be combined with other olfactory or visual or auditory effects. It could also be used alone or together with other effects as a wash time signal.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A health-and-hygiene appliance, the appliance comprising:

a dispersible component comprising an extruded foam having an exterior surface, wherein the dispersible component is adapted to substantially disperse in liquid, wherein the dispersible component defines an interior cavity; and a releasable component comprising a cleaning formulation, wherein at least a portion of said releasable component is attached to at least a portion of said exterior surface of said dispersible component after the dispersible component is formed; and wherein said releasable component is adapted to substantially release from said dispersible component before, during, or after dispersal of the dispersible component in liquid.

2. The health-and-hygiene appliance of claim 1 wherein the dispersible component disperses in water.

3. The health-and-hygiene appliance of claim 2 further comprising a binder, wherein said binder serves to attach at least a portion of the releasable component to at least a portion of the dispersible component.

4. The health-and-hygiene appliance of claim 3 wherein the binder comprises fat, oil, shea butter, wax, gum Arabic, a hydrocolloid, a water-soluble adhesive, a water-dispersible adhesive, a water-soluble hot-melt adhesive, maltodextrin, a gum solution, a starch solution, or some combination thereof.

5. The health-and-hygiene appliance of claim 2 wherein the mass of the releasable component is greater than about 0.1 gram.

6. The health-and-hygiene appliance of claim 2 wherein the appliance is adapted to be used once.

7. The health-and-hygiene appliance of claim 2 comprising a surfactant, wherein the surfactant is present in the releasable component, or in both the releasable component and the dispersible component.

8. The health-and-hygiene appliance of claim 2 wherein the appliance defines a shape configured to be dispensed in amounts selected by a user of the appliance.

9. The health-and-hygiene appliance of claim 2 comprising a moisturizing ingredient, wherein the moisturizing ingredient is present in the releasable component, or in both the releasable component and the dispersible component.

10. The health-and-hygiene appliance of claim 2 comprising an encapsulated ingredient, wherein the encapsulated ingredient is present in the releasable component, or in both the releasable component and the dispersible component.

11. The health-and-hygiene appliance of claim 1 wherein the releasable component is distributed substantially uniformly across the exterior surface of the dispersible component.

12. The health-and-hygiene appliance of claim 1 wherein the dispersible component further comprises a cleaning formulation.

13. The health-and-hygiene appliance of claim 1 wherein the appliance is adapted to convey a signal to a user of the appliance upon use of said appliance.

14. The health-and-hygiene appliance of claim 13 wherein the signal is detected by the user of the appliance by sight, by hearing, by touch, by smell, or some combination thereof.

15. The health-and-hygiene appliance of claim 13 wherein the signal is effected by a color-changing dye, a microencapsulated ingredient, a water-insoluble ingredient, an effervescing ingredient, or some combination thereof.

16. The health-and-hygiene appliance of claim 13 wherein the signal is effected by an interaction between two or more ingredients employed by the appliance.

17. The health-and-hygiene appliance of claim 1 further comprising a second releasable component contained in said interior cavity, wherein the second releasable component is the same or different than the releasable component attached to the exterior surface of the dispersible component.

* * * * *

UNITED STATES PATENT AND TRADEMARK OFFICE

CERTIFICATE OF CORRECTION

PATENT NO. : 7,612,031 B2
APPLICATION NO. : 11/305183
DATED : November 3, 2009
INVENTOR(S) : Lang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 860 days.

Signed and Sealed this

Nineteenth Day of October, 2010

David J. Kappos

David J. Kappos
*Director of the United States Patent and Trademark Office*